US010008811B2

(12) United States Patent
Ho

(10) Patent No.: US 10,008,811 B2
(45) Date of Patent: Jun. 26, 2018

(54) ELECTRICAL CONNECTOR

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/309,644

(22) PCT Filed: May 29, 2015

(86) PCT No.: PCT/IB2015/001211
§ 371 (c)(1),
(2) Date: Nov. 8, 2016

(87) PCT Pub. No.: WO2015/181629
PCT Pub. Date: Dec. 3, 2015

(65) Prior Publication Data

US 2017/0271820 A1 Sep. 21, 2017

(30) Foreign Application Priority Data

May 30, 2014 (CN) ..... 2014 2 0288762 U
May 30, 2014 (CN) ..... 2014 2 0289128 U

(51) Int. Cl.
*H01R 13/6585* (2011.01)
*H01R 13/6591* (2011.01)
(Continued)

(52) U.S. Cl.
CPC ..... *H01R 13/6585* (2013.01); *H01R 13/6591* (2013.01); *H01R 24/60* (2013.01); *H01R 2107/00* (2013.01)

(58) Field of Classification Search
CPC ..... H01R 24/60; H01R 13/6585; H01R 2107/00; H01R 12/724; H01R 13/6594;
(Continued)

(56) References Cited

U.S. PATENT DOCUMENTS 6,183,273 B1 2/2001 Yu et al.
6,743,047 B2 6/2004 Korsunsky et al.
(Continued)

FOREIGN PATENT DOCUMENTS

CN 201430237 Y 3/2010
EP 0268441 A2 5/1988
(Continued)

*Primary Examiner* — Michael A Lyons
*Assistant Examiner* — Matthew T Dzierzynski
(74) *Attorney, Agent, or Firm* — James A. O'Malley

(57) ABSTRACT

An electrical connector suitable to mate with another mating connector comprises an combined body, a grounding metal plate and an outer shielding shell. The combined body comprises a first terminal module and a second terminal module. The first terminal module has a first insulative piece and a plurality of first terminals. The first insulative piece has a first base portion and a first tongue portion. Each first terminal forms a first mating portion and a first soldering portion. The second terminal module has a second insulative piece assembled with the first insulative piece and a plurality of second terminals. The second insulative piece has a second base portion and a second tongue portion. Each second terminal forms a second mating portion and a second soldering portion. The grounding metal plate is interposed between the first terminal module and the second terminal module. The outer shielding shell surrounds an outer space of the first tongue portion and an outer space of the second tongue portion, and forms a mating cavity for insertion of the mating connector.

22 Claims, 23 Drawing Sheets

(51) Int. Cl.
*H01R 24/60* (2011.01)
*H01R 107/00* (2006.01)

(58) Field of Classification Search
CPC ..... H01R 13/6597; H01R 13/5202; H01R 13/6581; H01R 13/6582; H01R 13/6593; H01R 24/28; H01R 12/71; H01R 13/642; H01R 13/6591
See application file for complete search history.

(56) References Cited

U.S. PATENT DOCUMENTS

| | | | | |
|---|---|---|---|---|
| 7,094,086 | B2 | 8/2006 | Teicher | |
| 7,670,156 | B2 | 3/2010 | Chen | |
| 7,736,184 | B1 | 6/2010 | Wan et al. | |
| 8,388,380 | B1 * | 3/2013 | Van der Steen ... | H01R 13/5202 439/607.36 |
| 8,460,036 | B1 * | 6/2013 | Chen ..... | H01R 13/6474 439/660 |
| 8,475,216 | B2 * | 7/2013 | Tung ..... | H01R 13/506 439/607.4 |
| 8,684,769 | B2 * | 4/2014 | Kao ..... | H01R 13/6471 439/607.28 |
| 8,808,029 | B2 * | 8/2014 | Castillo ..... | H01R 13/6585 439/607.05 |
| 8,851,927 | B2 * | 10/2014 | Hsu ..... | H01R 12/724 439/607.11 |
| 8,968,031 | B2 * | 3/2015 | Simmel ..... | H01R 13/659 439/108 |
| 9,022,800 | B2 * | 5/2015 | Yang ..... | H01R 13/6581 439/487 |
| 9,178,319 | B2 * | 11/2015 | Little ..... | H01R 13/6585 |
| 9,214,765 | B2 * | 12/2015 | Zheng ..... | H01R 13/6581 |
| 9,252,542 | B2 * | 2/2016 | Little ..... | H01R 13/6585 |
| 9,281,625 | B2 * | 3/2016 | Kao ..... | H01R 13/6471 |
| 9,312,641 | B2 | 4/2016 | Wang et al. | |
| 9,478,905 | B2 | 10/2016 | Golko et al. | |
| 2004/0127098 | A1 | 7/2004 | Kuo et al. | |
| 2008/0176449 | A1 * | 7/2008 | Hu ..... | H01R 12/716 439/607.01 |
| 2010/0210124 | A1 | 8/2010 | Li | |
| 2010/0291798 | A1 * | 11/2010 | Kondo ..... | H01R 25/00 439/607.08 |
| 2013/0244492 | A1 | 9/2013 | Golko et al. | |
| 2013/0316581 | A1 | 11/2013 | Kao et al. | |
| 2014/0024263 | A1 | 1/2014 | Dong et al. | |

FOREIGN PATENT DOCUMENTS

| | | | |
|---|---|---|---|
| JP | 3109294 | U | 5/2005 |
| KR | 2011-0081361 | A | 7/2011 |
| WO | WO 03/012928 | A1 | 2/2003 |
| WO | WO 2009/069969 | A2 | 6/2009 |

* cited by examiner

ELECTRICAL CONNECTOR

RELATED APPLICATIONS

This application is a national stage application of PCT Application No. PCT/IB2015/001211, filed May 29, 2015, which claims priority to Chinese Application No. 201420289128.X, filed May 30, 2014, and Chinese Application No. 201420288762.1, filed May 30, 2014, all of which are incorporated herein by reference in their entirety.

TECHNICAL FIELD

The present disclosure relates to an electrical connector, and particularly relates to an electrical connector having a simple configuration and easily assembled.

BACKGROUND ART

In order to improve qualities of data transmission, power supply and electromagnetic shield of an electrical connector, a plurality of terminals with different functions are often provided on an insulative body of the electrical connector in an conventional electrical connector, and a shielding member is embedded in the insulative body so as to reduce electromagnetic interference during the data transmission of the terminals.

However, when the terminals or the shielding member or the like are added into the electrical connector, typically, complexity of the overall configuration of the electrical connector is significantly increased, for example, Chinese Patent Application No. 201320378153.0 discloses an electrical connector, a plurality of different assembling configurations are required to mold respectively so as to cooperate with a shielding member or the like for assembling, thereby complicating the configuration of the electrical connector, and in turn increasing the manufacture cost. Furthermore, the terminals of the electrical connector are provided on two opposite side surfaces of a tongue of the insulative body, respectively, thereby improving the difficulty of assembling and complicating the configuration and the assembly process. Moreover, the conventional electrical connector cannot fully shield all the electromagnetic radiation, once the electromagnetic radiation passes through the insulative body to leak rearwards, negative effects will be applied on a tail portion of the terminal, thereby decreasing the quality of the signal transmission. Therefore, there is still improved space for the conventional electrical connector.

SUMMARY

Therefore, an object of the present disclosure is to provide an electrical connector having a simple configuration and easily assembled.

Another object of the present disclosure is to provide an electrical connector with a better electromagnetic shielding effect.

Therefore, an electrical connector of the present disclosure is suitable to mate with another mating connector. In an embodiment, the electrical connector comprises a combined body, a grounding metal plate and an outer shielding shell. The combined body comprises a first terminal module and a second terminal module. The first terminal module has a first insulative piece and a plurality of first terminals fixed to the first insulative piece. The first insulative piece has a first base portion and a first tongue portion extending forwards from the first base portion. The first tongue portion has a first combined surface and a first mating surface opposite to each other. One end of each first terminal extends forwards from the first base portion to form a first mating portion exposed on the first mating surface, and the other end of each first terminal extends outwards from the first base portion to form a first soldering portion.

The second terminal module has a second insulative piece assembled with the first insulative piece and a plurality of second terminals fixed to the second insulative piece. The second insulative piece has a second base portion and a second tongue portion extending forwards from the second base portion. The second tongue portion has a second combined surface facing the first combined surface and a second mating surface opposite to the second combined surface. One end of each second terminal extends forwards from the second base portion to form a second mating portion exposed on the second mating surface, the other end of each second terminal extends outwards from the second base portion to form a second soldering portion. The grounding metal plate is interposed between the first terminal module and the second terminal module. The outer shielding shell surrounds an outer space of the first tongue portion and an outer space of the second tongue portion and forms a mating cavity for insertion of the mating connector.

In an embodiment, the first insulative piece further has at least a first fixing mechanism on the surface facing the second insulative piece; the second insulative piece is provided with a second fixing mechanism cooperating with and fixed to the first fixing mechanism.

In an embodiment, the grounding metal plate is formed with at least a through hole corresponding to the first fixing mechanism and the second fixing mechanism; the first fixing mechanism and the second fixing mechanism are respectively a fixing protruding post and a fixing hole which cooperate with each other, the first fixing mechanism passes through the through hole of the grounding metal plate to engage with the second fixing mechanism.

In an embodiment, two opposite surfaces of the grounding metal plate respectively attach on the first combined surface of the first tongue portion and the second combined surface of the second tongue portion, the grounding metal plate is provided with two mating side edges respectively exposed out of the first tongue portion and the second tongue portion.

In an embodiment, a configuration of the first terminal module and a configuration of the second terminal module are the same, a fixed legs extend respectively from each of the first insulative piece and the second insulative piece.

In an embodiment, the first terminal module is provided above the second terminal module, at least a fixed leg extends downwards from the second base portion of the second insulative piece.

In an embodiment, the electrical connector further comprises an inner shielding shell provided to the combined body; the inner shielding shell is positioned between the outer shielding shell and the first base portion and the second base portion, and covers at least a rear section of the first tongue portion and the second tongue portion.

In an embodiment, the inner shielding shell comprises a fixed section and an extending section, the fixed section abuts against an inner surface of the outer shielding shell and is fixed to the first base portion or the second base portion, the extending section covers the rear section of the first tongue portion and the second tongue portion.

In an embodiment, the inner shielding shell comprises two metal plates respectively attaching on the first insulative piece and the second insulative piece; and each metal plate has a front extending plate attaching on the rear section of the first tongue portion or the rear section of the second tongue portion, a rear extending plate attaching on the corresponding first base portion or the corresponding second base portion and a connecting plate perpendicular to the front extending plate and the rear extending plate.

In an embodiment, a front end of each front extending plate forms a guiding front edge; a gap is formed between each guiding front edge and each combined body to allow the guiding front edge slightly displace toward the combined body.

In an embodiment, two sides of the combined body are further formed with two receiving grooves respectively adjacent to the two sides of the front extending plate; a rear side of each receiving groove has a channel extending vertically and penetrating the first base portion and the second base portion; each metal plate further has two fixed protruding tabs provided at two sides of the corresponding front extending plate; each fixed protruding tab extends from the corresponding front extending plate and extends into the adjacent receiving groove and latches on to the corresponding channel.

In an embodiment, each metal plate further has at least a connecting elastic tab extending away from the combined body; each connecting elastic tab is engaged with the outer shielding shell.

In an embodiment, the electrical connector comprises a combined body, a grounding metal plate, an outer shielding shell and an inner shielding shell. The combined body comprises: an insulative body having a main body and a tongue protruding forwards from the main body, the tongue has an upper surface and a lower surface; and a plurality of terminals divided into an upper row and a lower row and fixed to the insulative body, each terminal has a contact portion extending forwards and exposed out of the tongue and a tail portion extending out of the insulative body, the contact portions of the terminals in the upper row are exposed on the upper surface of the tongue and the contact portions of the terminals in the lower row are exposed on the lower surface of the tongue. The grounding metal plate is fixed in the combined body and is a plate positioned between the terminals in the upper row and the terminals in the lower row. The outer shielding shell engages with the insulative body and surrounds an outer space of the tongue to define a mating cavity. The inner shielding shell is positioned in an inner side of the outer shielding shell and provided on a surface of the combined body, the inner shielding shell has an upper metal plate and a lower metal plate, the upper metal plate has at least a connecting elastic tab extending away from the combined body, the connecting elastic tab is connected to the outer shielding shell.

In an embodiment, the lower metal plate has at least a connecting elastic tab extending away from the combined body, the connecting elastic tabs are connected to the outer shielding shell.

In an embodiment, the lower metal plate has at least a soldering leg extending away from the combined body, the soldering leg extends out of the outer shielding shell and is soldered to the corresponding circuit board for achieving grounding.

In an embodiment, the grounding metal plate comprises a first shielding portion and a second shielding portion extending from the first shielding portion, the first shielding portion is fixed in the insulative body, the second shielding portion and the tail portions of the terminals extend out of the insulative body along the same direction.

In an embodiment, the outer shielding shell has at least a soldering leg to be soldered to the circuit board for achieving grounding.

In an embodiment, the insulative body is assembled by a first insulative piece and a second insulative piece, the terminals in the upper row are embedded in the first insulative piece, the terminals in the lower row are embedded in the second insulative piece, the grounding metal plate is interposed between the first insulative piece and the second insulative piece.

In an embodiment, the first insulative piece comprises a first base portion and a first tongue portion extending forwards from the first base portion, the contact portions of the terminals in the upper row are exposed out of the first tongue portion; the second insulative piece comprises a second base portion and a second tongue portion extending forwards from the second base portion, the contact portions of the terminals in the lower row are exposed out of the second tongue portion; the first tongue portion and the second tongue portion are assembled to form the tongue of the insulative body, the first base portion and the second base portion are assembled to form the main body of the insulative body.

The effects of the present disclosure are as follows: by the design of the first terminal module and the second terminal module, the first terminal and the second terminal may be respectively fixed on a side surface of the first insulative piece and a side surface of the second insulative piece first, and then the first terminal module and the second terminal module are assembled and interpose the grounding metal plate therebetween, thereby decreasing the difficulty of the assembling process. Moreover, the grounding metal plate has the exposed mating side edge and the electrical connector is provided with the inner shielding shell, thereby making the electrical connector achieve a better electromagnetic shielding effect; in addition, the inner shielding shell and the outer shielding shell are connected via the connecting elastic tab, the inner shielding shell may achieve a grounding effect via the outer shielding shell, thereby making the electrical connector achieve a better electromagnetic shielding effect.

BRIEF DESCRIPTION OF THE DRAWINGS

The foregoing and other features and effects of the embodiments of the present disclosure will be apparent through the embodiments with reference to the Figures, and in Figures.

DETAILED DESCRIPTION OF THE PREFERRED EMBODIMENTS

The foregoing and other technical contents, features and effects of the present disclosure will be apparent through the following detailed description for two specific embodiments in combination with the Figures.

Figure 1:
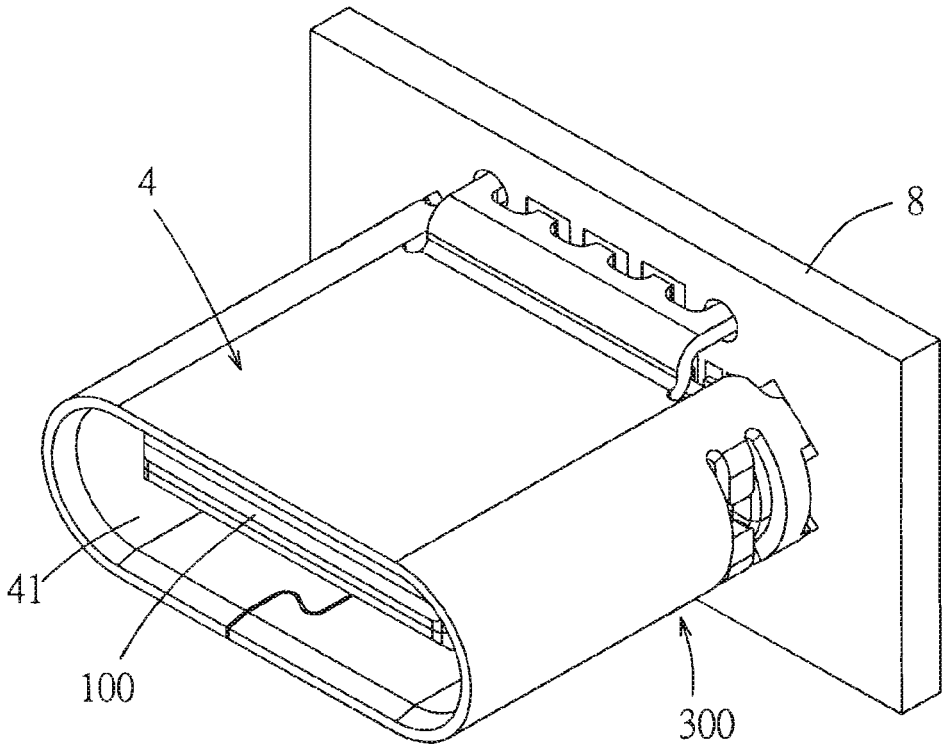
FIG. 1 is a perspective view illustrating a first embodiment of an electrical connector of the present disclosure.
Figure 1:
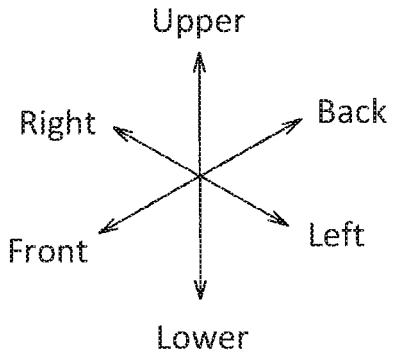
Figure 2:
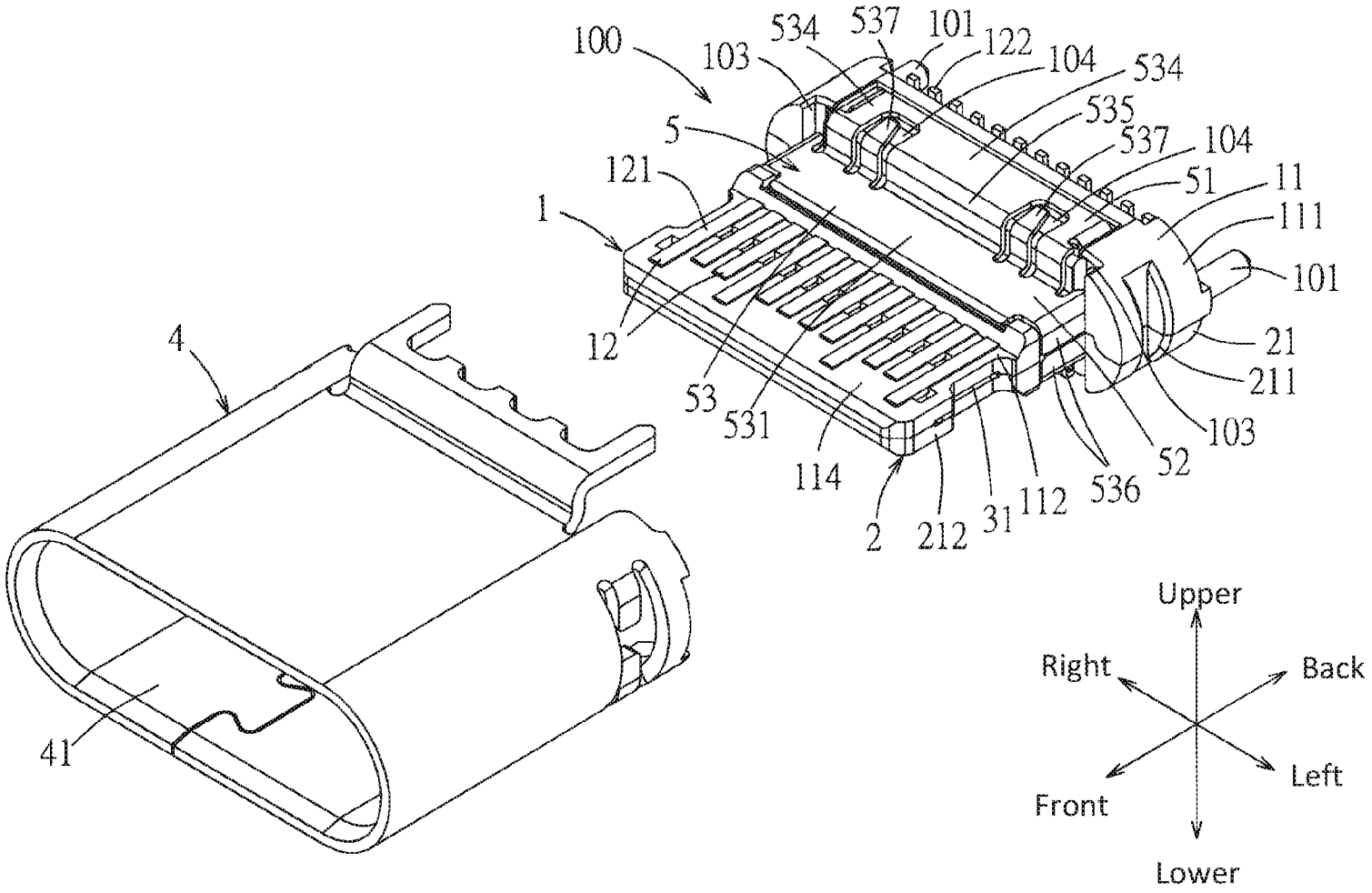
FIG. 2 is an exploded perspective view illustrating components of the first embodiment of the present disclosure.
Figure 3:
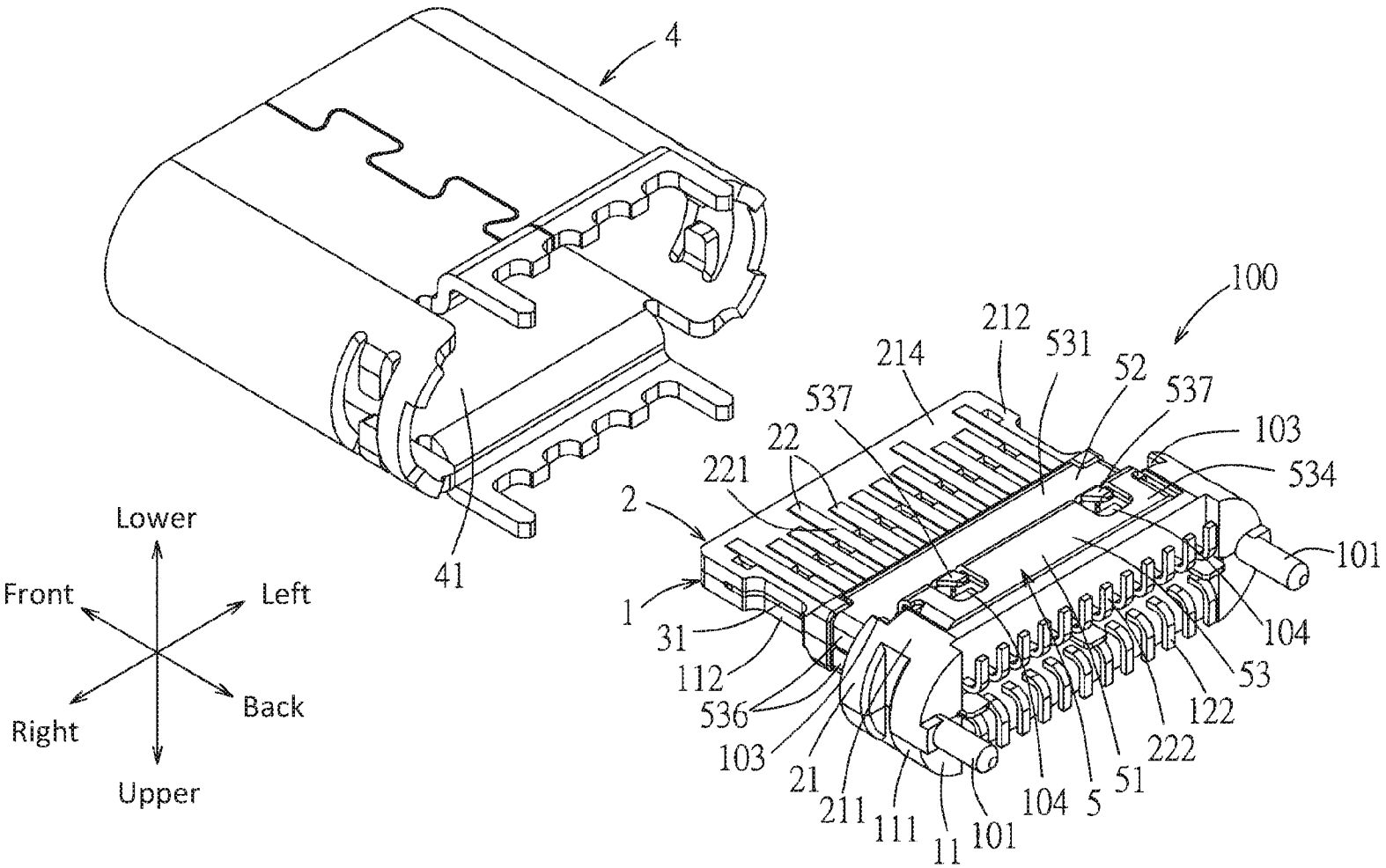
FIG. 3 is an exploded perspective view illustrating the components of the first embodiment of the present disclosure viewed from another angle.
Figure 9:
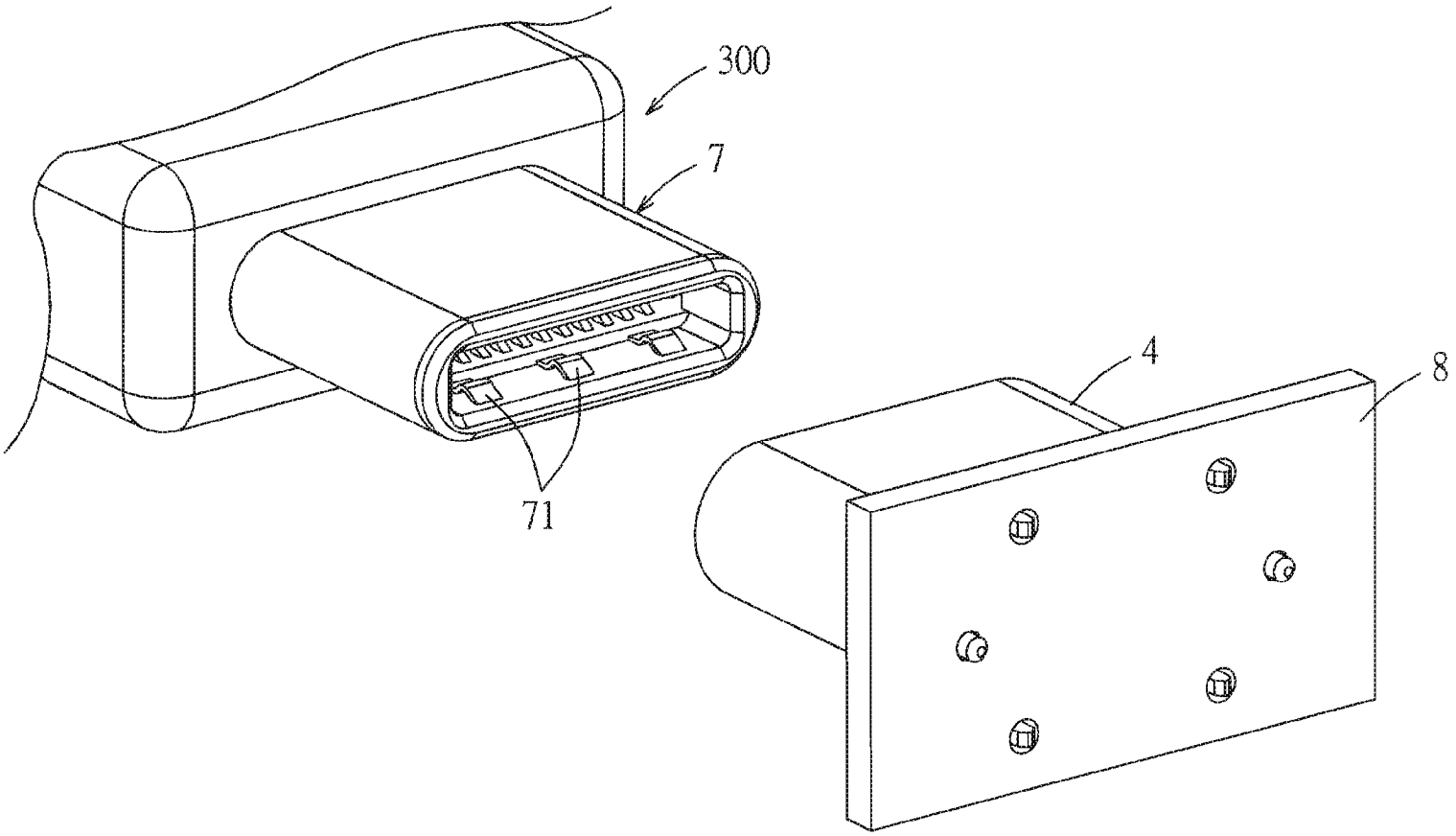
FIG. 9 is a perspective view illustrating the first embodiment is mated with another mating connector.

Referring to FIG. 1 to FIG. 3, a first embodiment of an electrical connector of the present disclosure is illustrated. Specifically, the first embodiment is a receptacle connector suitable for insertion and connection of another mating connector 7 (see FIG. 9). The electrical connector 300 comprises an combined body 100, a grounding metal plate 3 fixed in the combined body 100 (see FIG. 5), an outer shielding shell 4 surrounding the combined body 100 and an inner shielding shell 5 positioned in an inner side of the outer shielding shell 4 and provided on a surface of the combined body 100.

Figure 4:
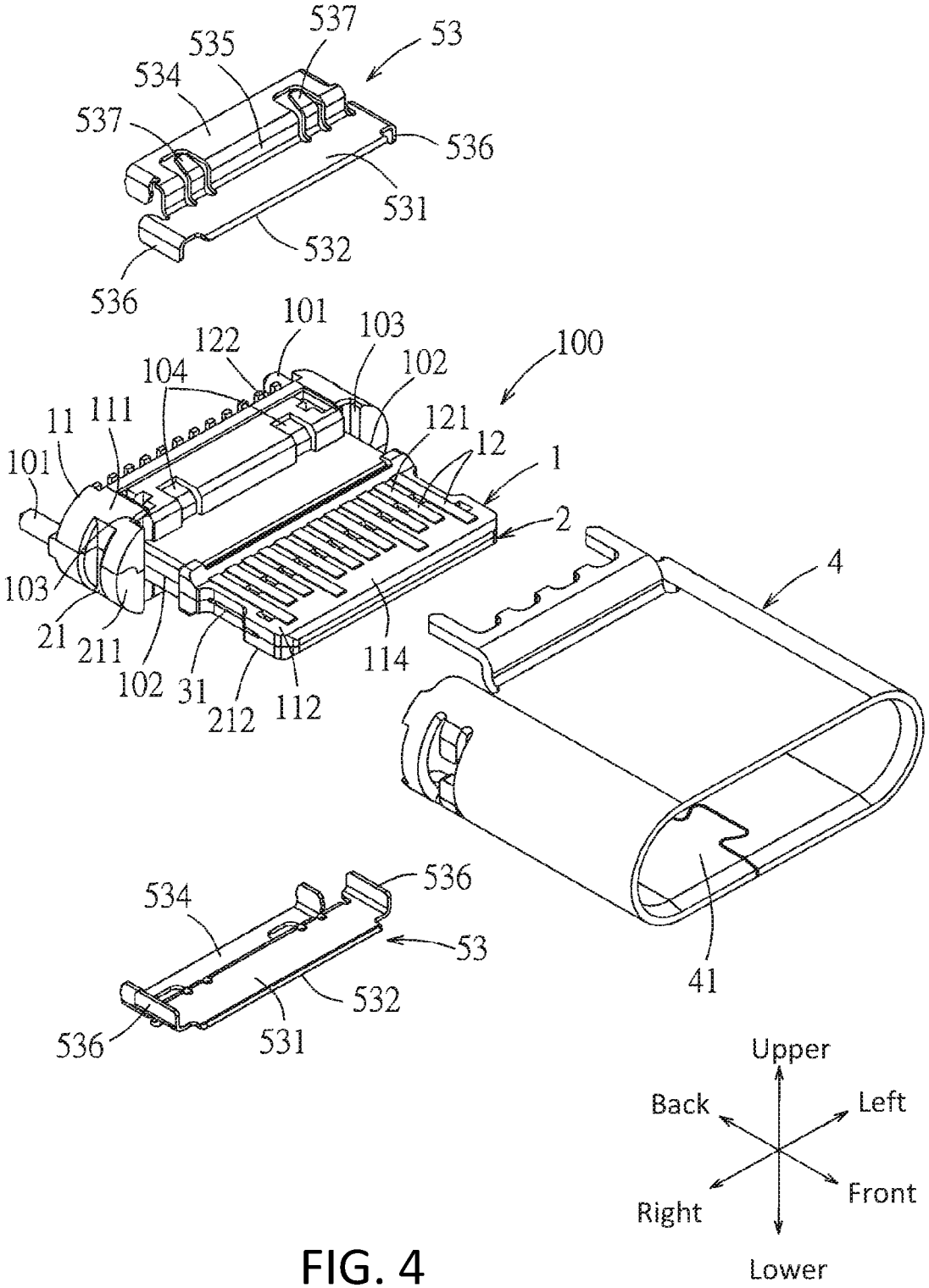
FIG. 4 is an exploded perspective view illustrating an assembling relationship between two metal plates of an inner shielding shell.
Figure 5:
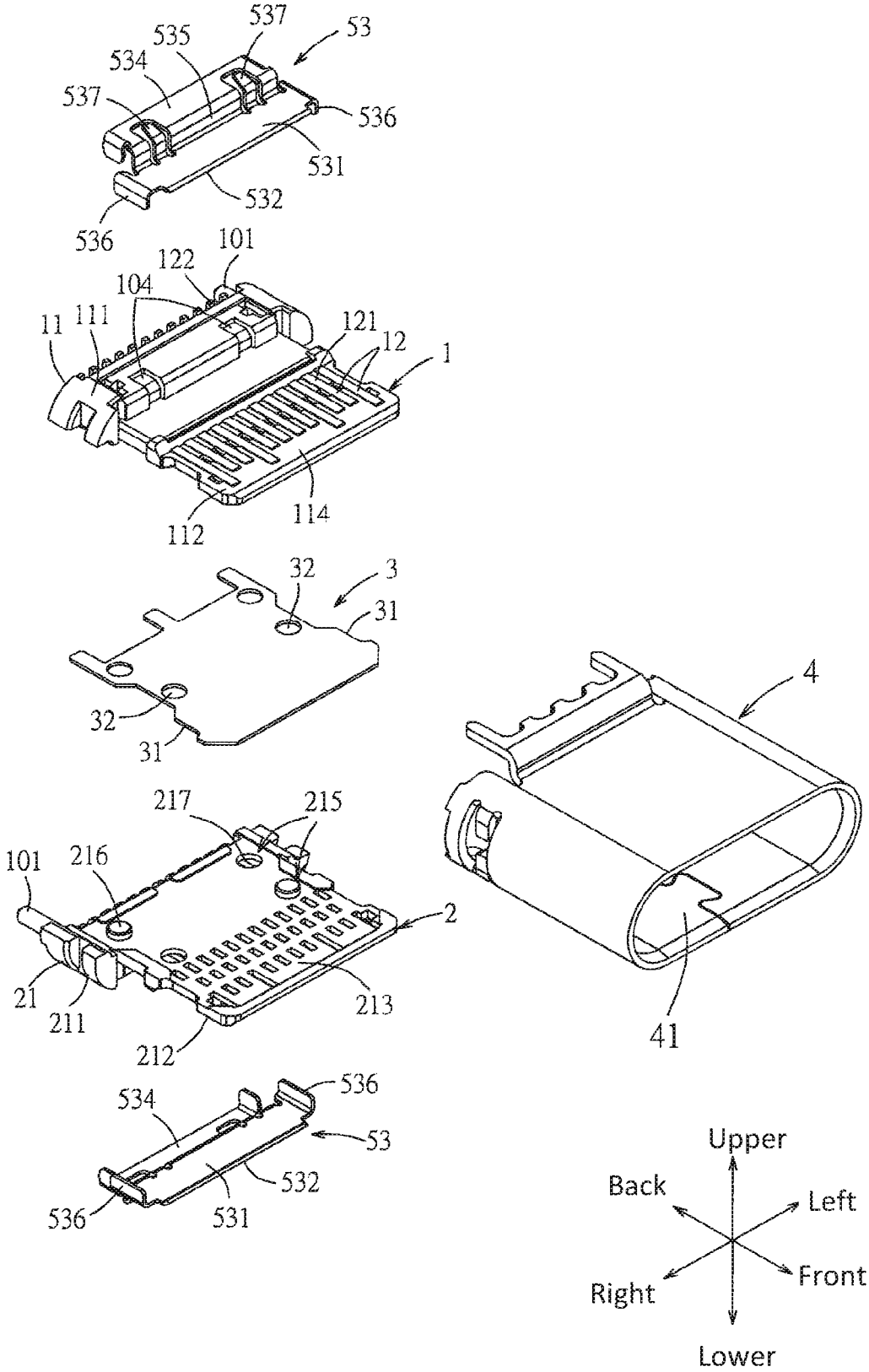
FIG. 5 is an exploded perspective view illustrating components of an combined body.
Figure 6:
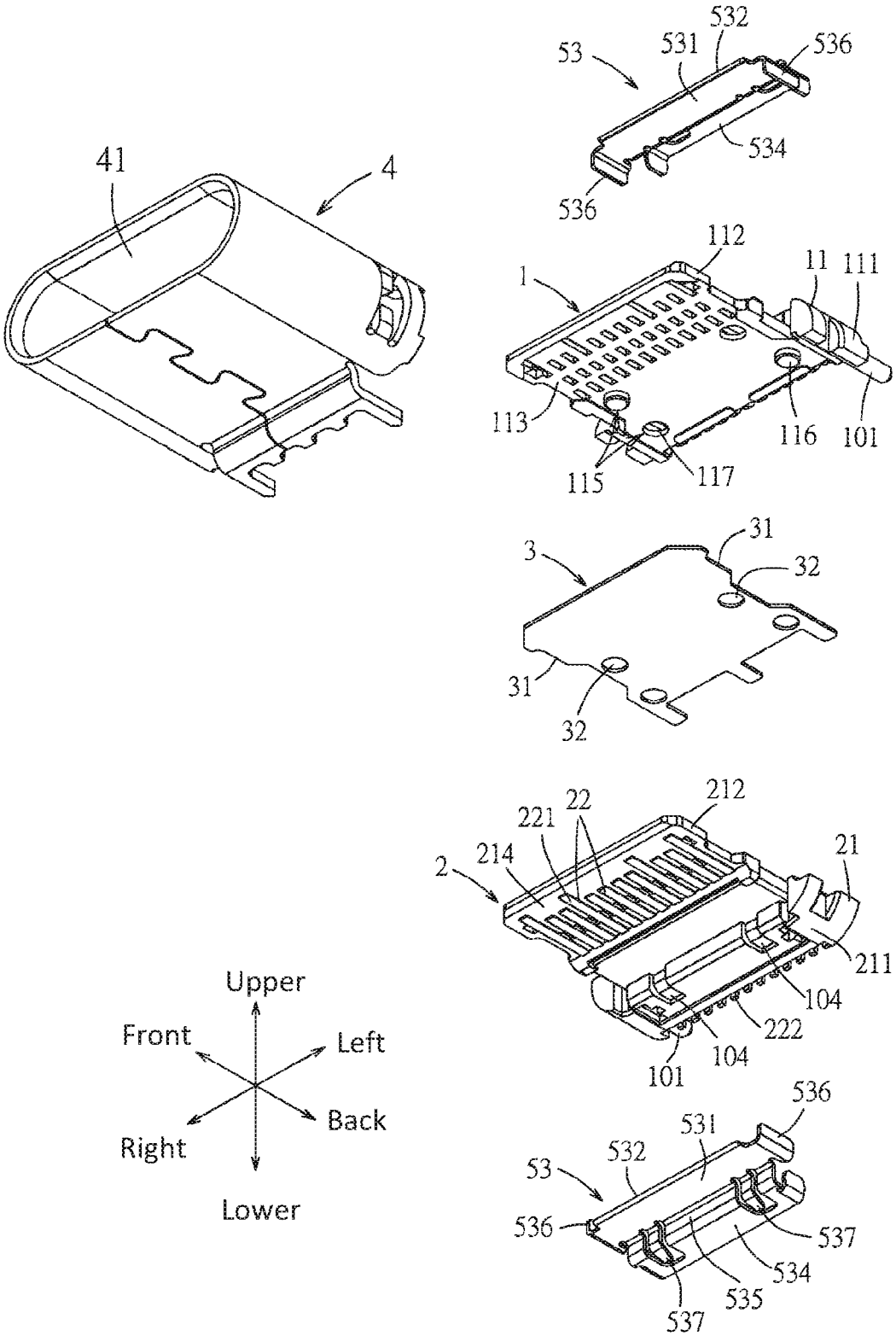
FIG. 6 is an exploded perspective view illustrating the components of the combined body viewed from another angle.
Figure 7:
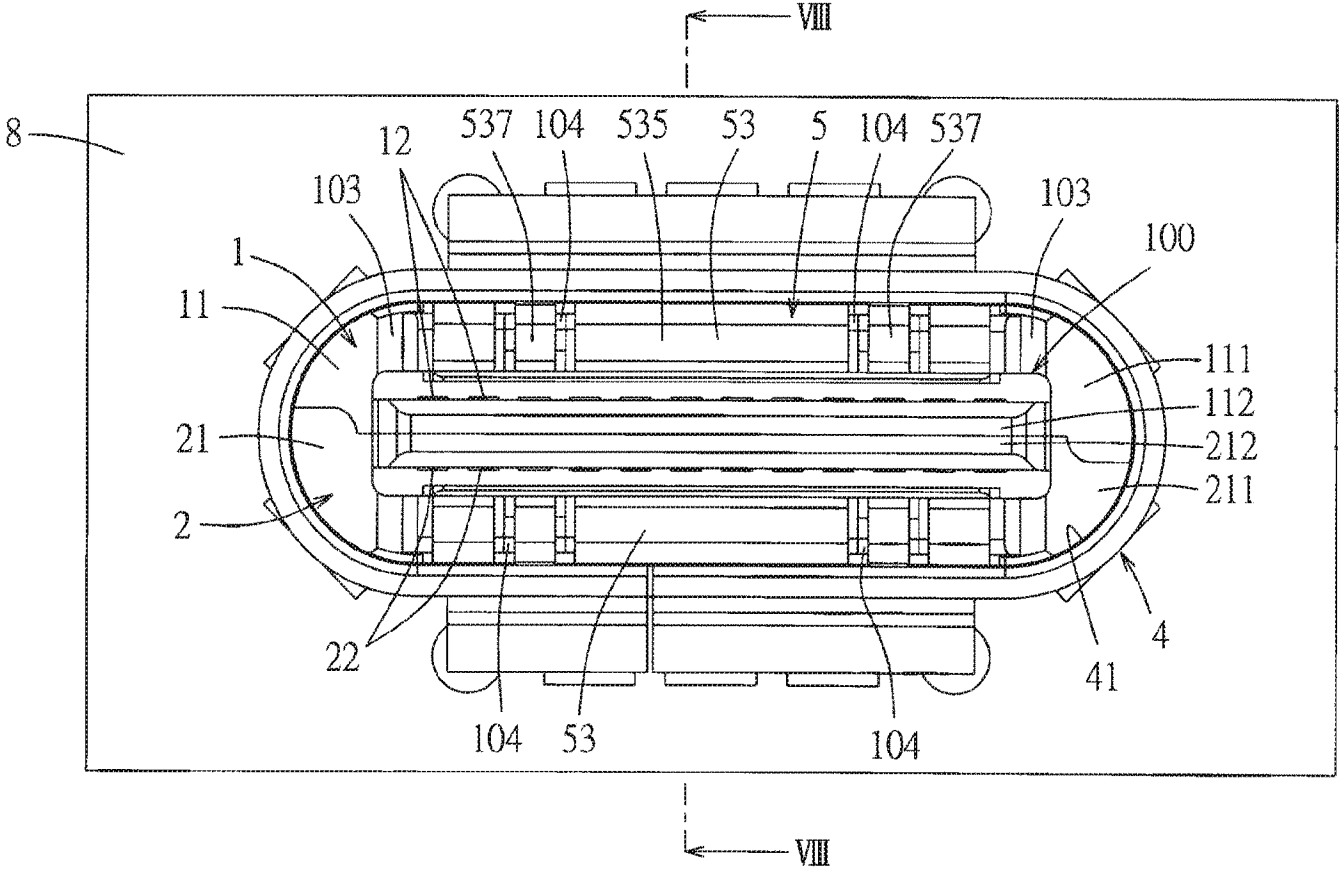
FIG. 7 is a front view illustrating a front side of the first embodiment.
Figure 8:
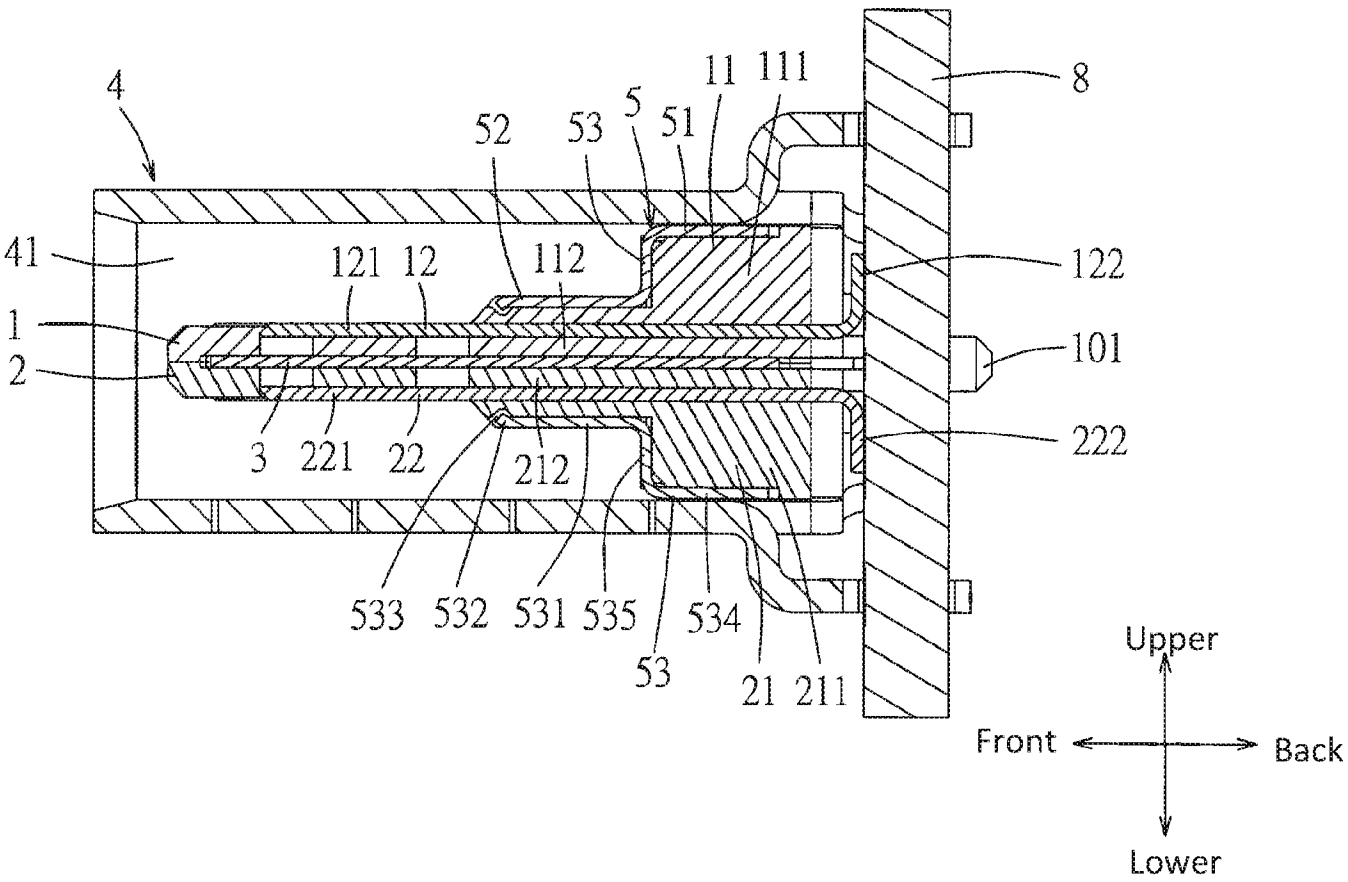
FIG. 8 is a cross sectional view taken along a line VIII-VIII of FIG. 7 illustrating an inner portion of the first embodiment.

Referring to FIG. 4 to FIG. 6, the combined body 100 comprises a first terminal module 1 and a second terminal module 2 assembled with each other. The first terminal module 1 has a first insulative piece 11 and a plurality of first terminals 12 embedded in the first insulative piece 11. The first insulative piece 11 has a first base portion 111, a first tongue portion 112 extending forwards from a front side of the first base portion 111 and two first fixing mechanisms 115 facing downwards the second terminal module 2. The first tongue portion 112 has a first combined surface 113 facing downwards the second terminal module 2 and a first mating surface 114 opposite to the first combined surface 113. The first terminal 12 is fixed to the first base portion 111, and a front end of the first terminal 12 extends forwards from the first base portion 111 to form a first mating portion 121 exposed on the first mating surface 114, and a rear end of the first terminal 12 extends outwards from the first base portion 111 to form a first soldering portion 122 to be soldered to a circuit board 8 (see FIG. 7 and FIG. 8).

A configuration of the second terminal module 2 is the same as the configuration of the first terminal module 1, and the configuration of the second terminal module 2 and the configuration of the first terminal module 1 are in 180 degrees rotational symmetry. The second terminal module 2 has a second insulative piece 21 assembled upwards to the first insulative piece 11 and a plurality of second terminals 22 embedded in the second insulative piece 21. The second insulative piece 21 has a second base portion 211 corresponding to the first base portion 111 in position, a second tongue portion 212 extending forwards from a front side of the second base portion 211 and corresponding to the first tongue portion 112 in position and two second fixing mechanisms 215 cooperating with and fixed to the first fixing mechanism 115 of the first insulative piece 11. The second tongue portion 212 has a second combined surface 213 facing upwards the first combined surface 113 and a second mating surface 214 opposite to the second combined surface 213. A front end of the second terminal 22 extends forwards from the second base portion 211 to form a second mating portion 221 exposed on the second mating surface 214, a rear end of the second terminal 22 extends outwards from the second base portion 211 to form a second soldering portion 222 to be soldered to the circuit board 8 (see FIG. 7 and FIG. 8).

The combined body 100 further comprises two fixed legs 101 respectively provided at a rear side of the first base portion 111 and a rear side of the second base portion 211, two receiving grooves 102 respectively formed on the left side and the right side of the combined body 100 and respectively adjacent to a rear section of the first tongue portion 112 and a rear section of the second tongue portion 212, and four recessed portions 104 respectively formed on a top surface of the first base portion 111 and a bottom surface of the second base portion 211. The two fixed legs 101 respectively extend from a rear side of the first insulative piece 11 and a rear side of the second insulative piece 21 and extend rearwards far away from the first insulative piece 11 and the second insulative piece 21, pass through and are fixed to the circuit board 8 (see FIG. 7 and FIG. 8).

The grounding metal plate 3 is interposed between the first terminal module 1 and the second terminal module 2, thereby increasing the strength of the configuration of a tongue assembled by the first tongue portion 112 and the second tongue portion 212 and decreasing the crosstalk of high frequency signals between the first terminal 12 and the second terminal 22. Two opposite surfaces of the grounding metal plate 3 respectively attach on the first combined surface 113 of the first tongue portion 112 and the second combined surface 213 of the second tongue portion 212, the grounding metal plate 3 is provided with two mating side edges 31 exposed out of the first tongue portion 112 and the second tongue portion 212 respectively at a left side and a right side and four through holes 32 vertically penetrating the grounding metal plate 3. The four through holes 32 correspond to the two first fixing mechanisms 115 of the first insulative piece 11 and the two second fixing mechanisms 215 of the second insulative piece 21, therefore the two first fixing mechanisms 115 pass through four through holes 32 of the grounding metal plate 3 to fix and engage with the two second fixing mechanisms 215 and position the grounding metal plate 3 at the same time. In a first embodiment, specifically, each first fixing mechanism 115 comprises a fixing protruding post 116 and a fixing hole 117, each second fixing mechanism 215 comprises a fixing protruding post 216 and a fixing hole 217 which respectively cooperates with the fixing hole 117 and the fixing protruding post 116.

The outer shielding shell 4 surrounds an outer space of the first tongue portion 112 and an outer space of the second tongue portion 212 of the combined body 100, and forms a mating cavity 41 for insertion of the mating connector 7. The inner shielding shell 5 is positioned between the outer shielding shell 4 and the first base portion 111 and the second base portion 211, and at least covers the rear section of the first tongue portion 112 and the rear section of the second tongue portion 212, preferably, the inner shielding shell 5 further covers a front surface of the first base portion 111 facing the mating cavity 41 or a front surface of the second base portion 211 facing the mating cavity 41. Preferably, the inner shielding shell 5 has a fixed section 51 fixed to a front section of the first base portion 111 or a front section of the second base portion 211 and abutting against an inner surface of the outer shielding shell 4 and an extending section 52 attaching on and surrounding the rear section of the first tongue portion 112 and the rear section of the second tongue portion 212, thereby preventing electromagnetic radiation from passing through the combined body 100 to leak rearwards. Specifically, in the embodiment, the inner shielding shell 5 has two metal plates 53 assembled with each other. The two metal plates 53 are respectively positioned at an upper side and a lower side of the combined body 100 to respectively attach on and be fixed to the first insulative piece 11 and the second insulative piece 21.

Each metal plate 53 is substantially a step-shape, and has a front extending plate 531 horizontally attaching on the rear section of the first tongue portion 112 or the rear section of the second tongue portion 212, a rear extending plate 534 horizontally attaching on the front section of the first base portion 111 or the front section of the second base portion 211, a connecting plate 535 connecting the front extending plate 531 and the rear extending plate 534 and extending vertically, two fixed protruding tabs 536 provided at a left side and a right side of the front extending plate 531 and two connecting elastic tabs 537 extending away from the combined body 100. A front end of each front extending plate 531 forms a guiding front edge 532, a gap 533 is formed between each guiding front edge 532 and the combined body 100 (see FIG. 7 and FIG. 8), therefore the guiding front edge 532 may slightly displace toward the combined body 100 when the mating connector 7 is inserted into the mating cavity 41, which facilitates the insertion of the mating connector 7. The two receiving grooves 102 positioned at the left side and the right side of the combined body 100 are respectively adjacent to a left side and a right side of each front extending plate 531, and a rear side of each receiving groove 102 has a channel 103 extending vertically and penetrating the first base portion 111 and the second base portion 211. Each fixed protruding tab 536 extends from the corresponding front extending plate 531 and extends into the adjacent receiving groove 102, and latches on to the corresponding channel 103 to engage with the combined body 100. Each connecting elastic tab 537 is correspondingly received in the recessed portion 104, and an end of each connecting elastic tab 537 is elastically engaged with the outer shielding shell 4, thereby making the inner shielding shell 5 grounded via the outer shielding shell 4 for achieving a grounding effect.

When the electrical connector 300 of the present disclosure is mated with the mating connector 7, each shielding configuration is able to produce a plurality of grounding circuits so as to improve the electromagnetic shielding effect. More specifically, the grounding metal plate 3 not only connects the circuit board 8 positioned at a rear side of the grounding metal plate 3 to form a grounding circuit, but also connects metal elastic arms (not shown) of an outer shell of the mating connector 7 via the mating side edges 31 exposed at the left side and the right side of the grounding metal plate 3, thereby forming another grounding circuit to provide a grounding function for the mating connector 7. Furthermore, the inner shielding shell 5 connects the outer shielding shell 4 via the connecting elastic tabs 537 to form a grounding circuit, and connects grounding elastic tabs 71 (see FIG. 9) of the mating connector 7 to form another grounding circuit when the mating connector 7 is inserted, thereby further improving the electromagnetic shielding effect of the inner shielding shell 5 and the outer shielding shell 4.

It should be emphatically noted that, as the configuration of the first terminal module 1 and the configuration of the second terminal module 2 in the first embodiment are completely the same, the different assembling configurations are not needed to be molded separately, and the first terminal module 1 and the second terminal module 2 are assembled and interpose the grounding metal plate 3 as long as only one type of terminal module is needed, thereby significantly simplifying the complexity of the molding process and the whole configuration. Moreover, the first terminal 12 and the second terminal 22 can be respectively embedded on a side surface of the first insulative piece 11 and a side surface of the second insulative piece 21 first and then assembled, thereby decreasing the difficulty of the assembling process and the complexity of an assembling device. Also, as the configuration of the first terminal 12 of the first terminal module 1 and the configuration of the second terminal 22 of the second terminal module 2 are completely the same and in 180 degrees rotational symmetry, the corresponding mating connector 7 may be properly engaged with the terminals of the electrical connector whether the mating connector 7 is inserted into the electrical connector 300 with a proper orientation or with an upside down orientation In conclusion, by the design of the first terminal module 1 and the second terminal module 2, the first terminal 12 and the second terminal 22 may be respectively embedded in a side surface of the first insulative piece 11 and a side surface of the second insulative piece 21 first, and then the first terminal module 1 and the second terminal module 2 are assembled and interpose the grounding metal plate 3 therebetween, thereby decreasing the difficulty of the assembling process and the complexity of the assembling device. Moreover, by that the grounding metal plate 3 is provided between the first terminal 12 and the second terminal 22 and the inner shielding shell 5 is positioned at the rear portion of the combined body 100 and the outer shielding shell 4 surrounds the first tongue portion 112 and the second tongue portion 212, the electromagnetic shielding configuration of the electrical connector 300 forms a plurality of grounding circuits and forms an entire shielding configuration, so as to attain a better electromagnetic shielding effect. And the object of the present disclosure is indeed achieved.

Referring to FIG. 10 to FIG. 24, a second embodiment of the electrical connector of the present disclosure is provided. The electrical connector 300*c* is a right angle connector.

Figure 10:
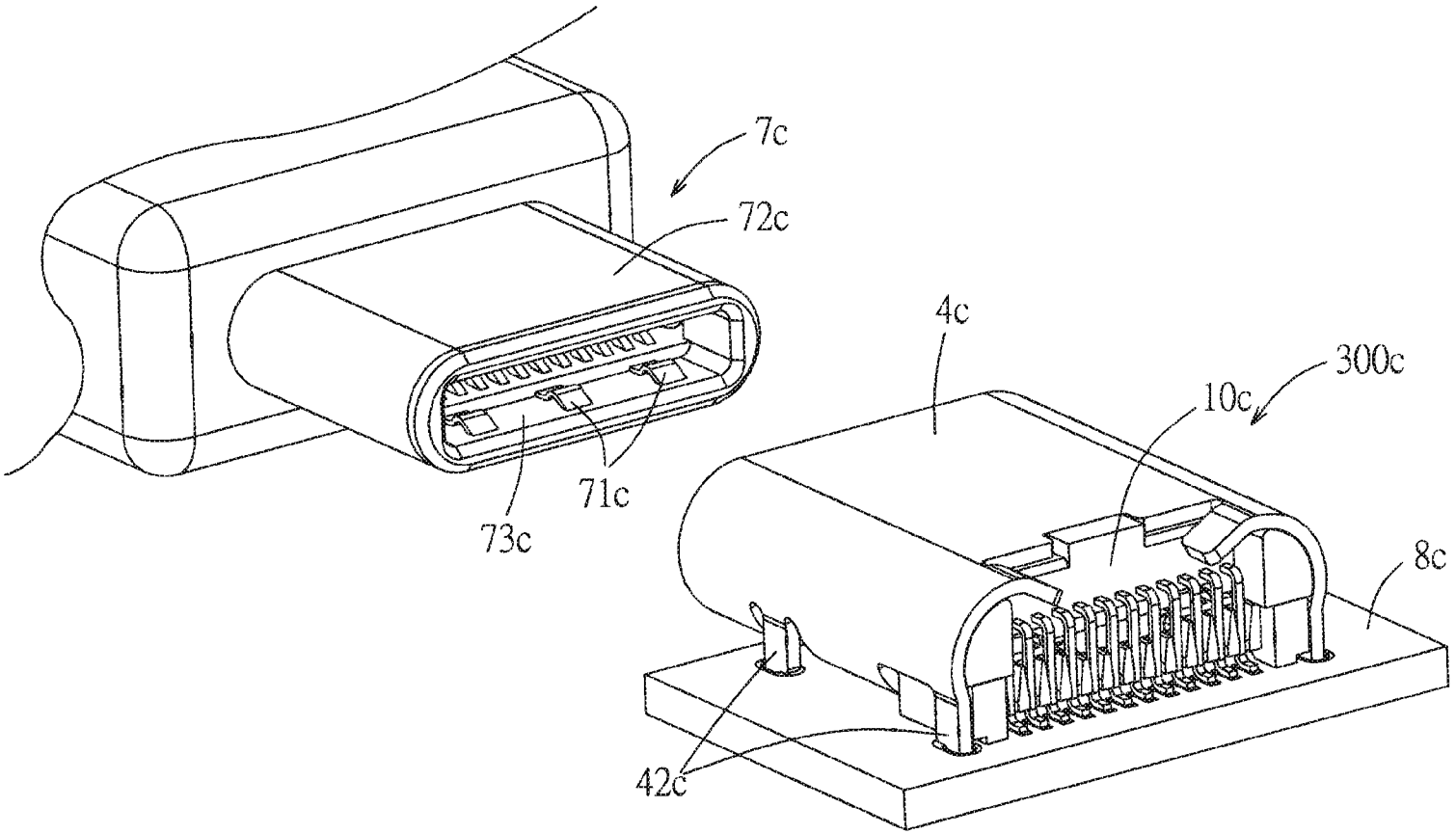
FIG. 10 is a perspective view illustrating an electrical connector of a second embodiment of the present disclosure is provided on a circuit board and illustrating a mating relationship between the electrical connector and a plug connector.
Figure 11:
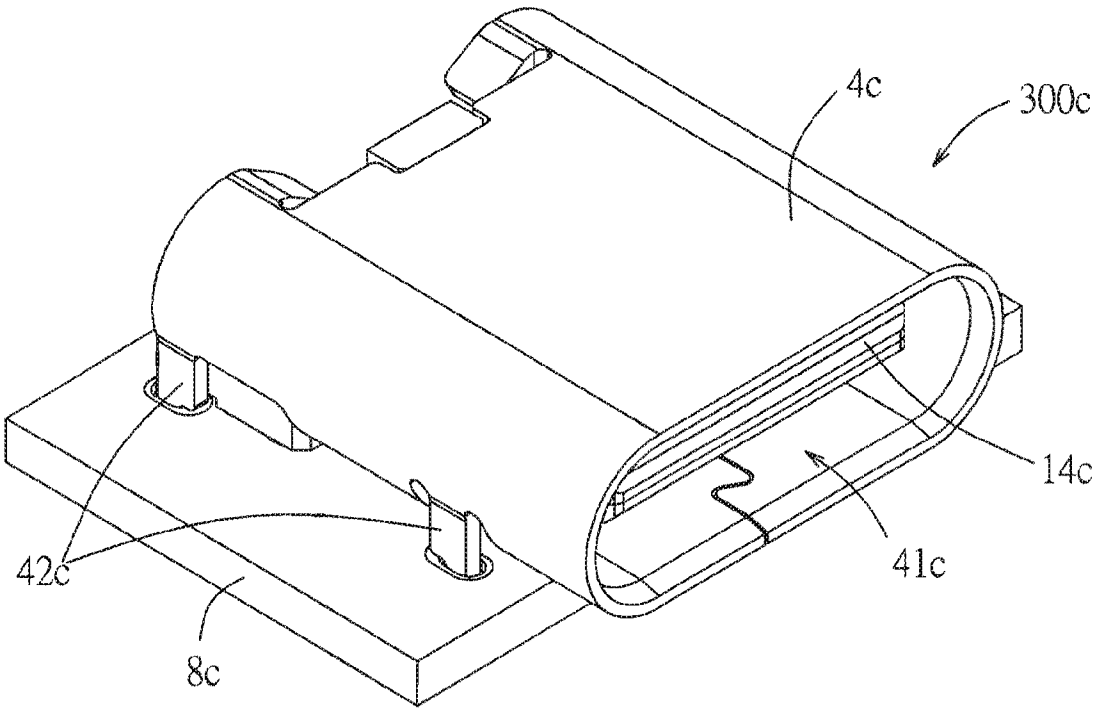
FIG. 11 is a perspective view illustrating the second embodiment is provided on a circuit board.
Figure 12:
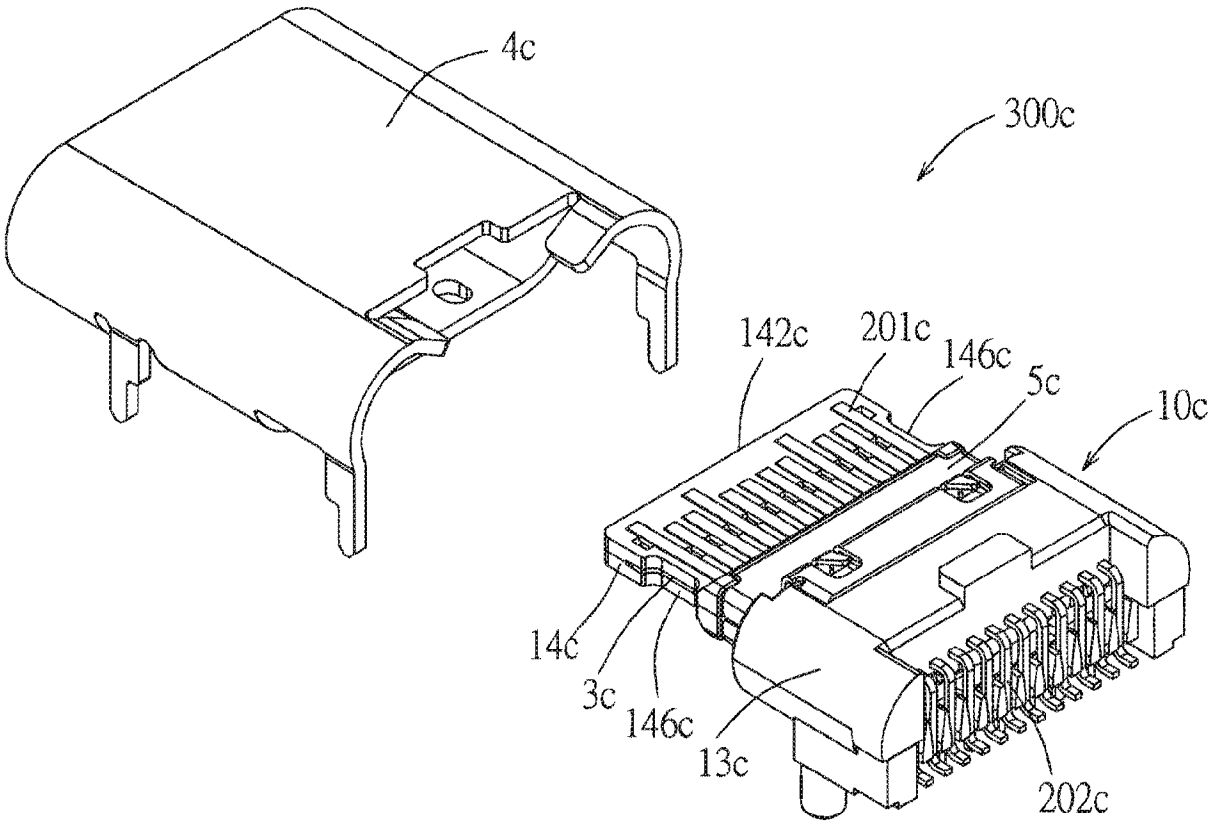
FIG. 12 is an exploded perspective view illustrating an combined relationship between an outer shielding shell and an insulative body of the second embodiment.
Figure 13:
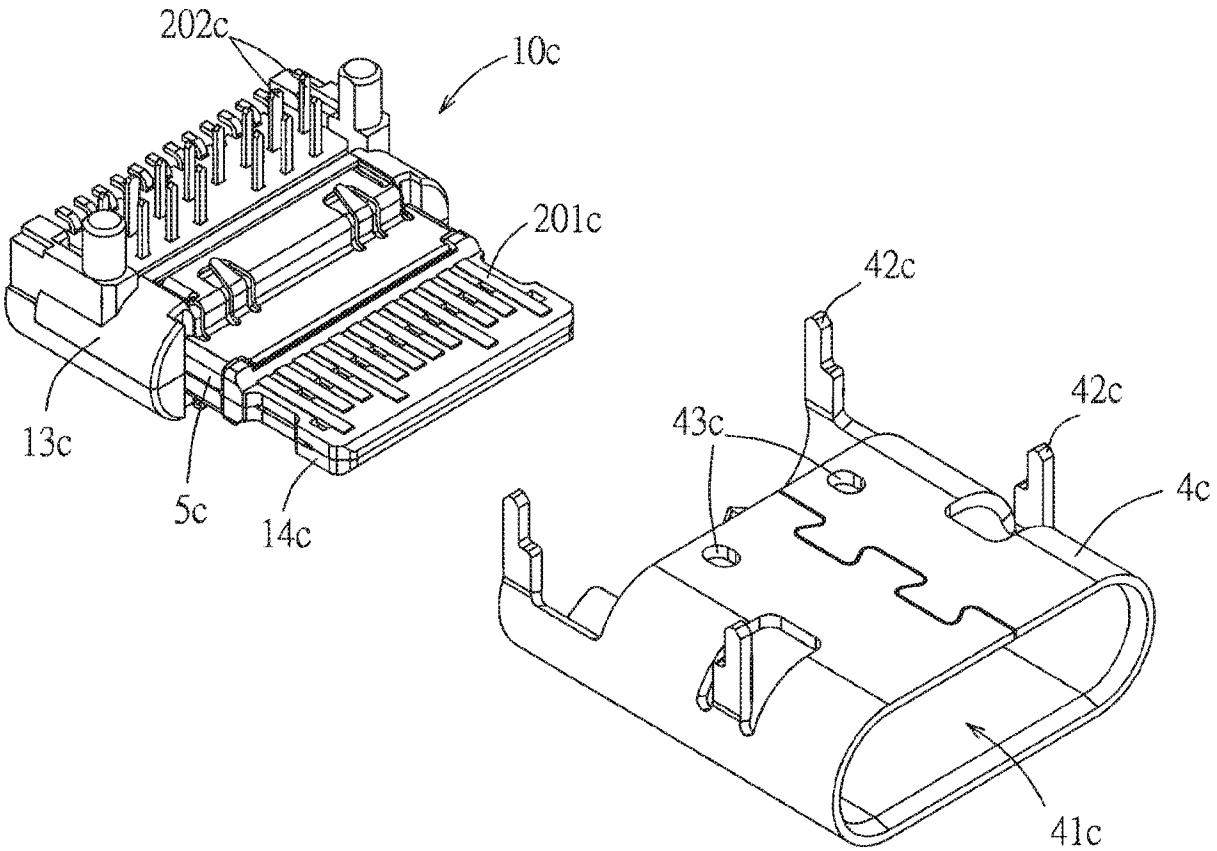
FIG. 13 is a view of FIG. 12 viewed from another angle.
Figure 14:
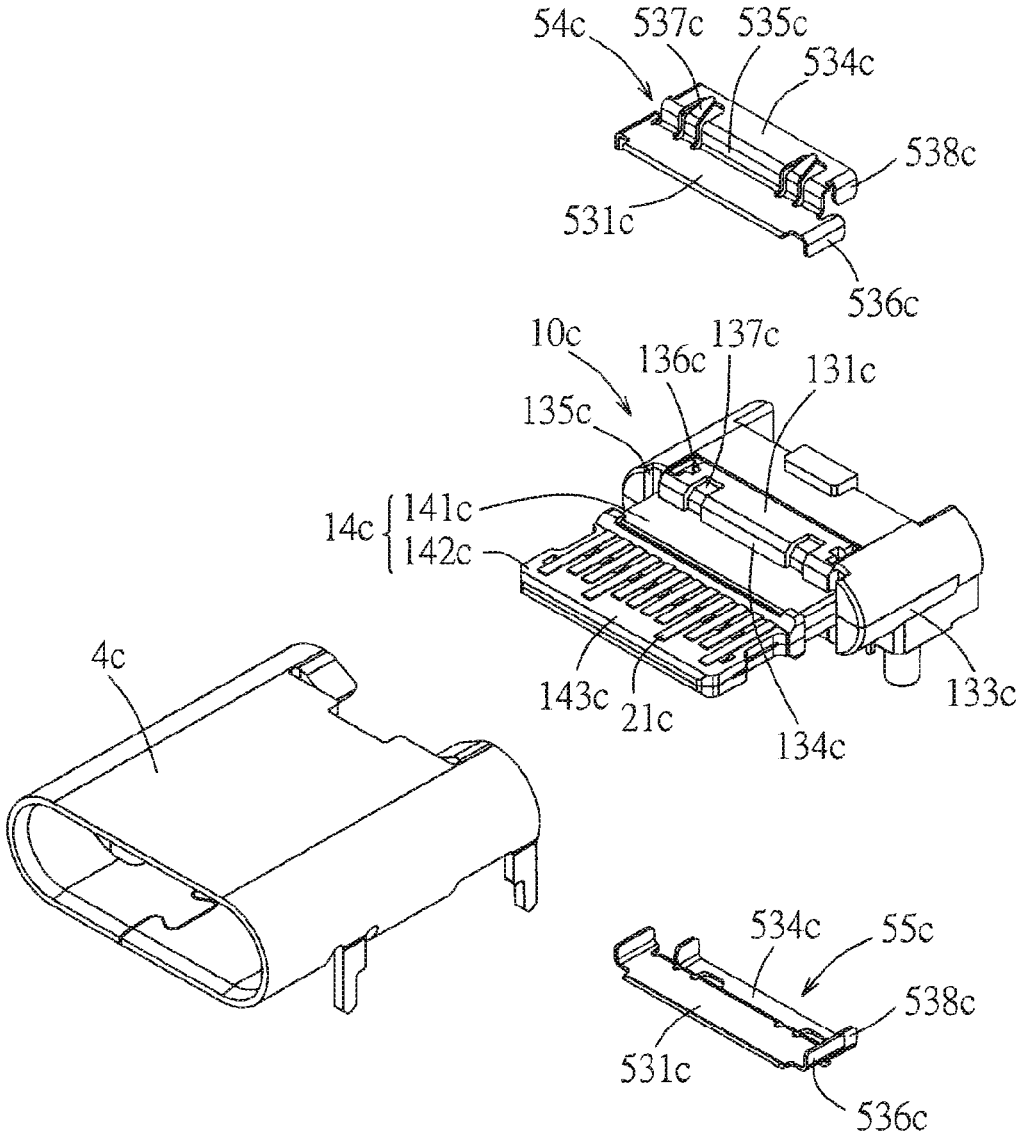
FIG. 14 is an exploded perspective view illustrating an combined relationship between an inner shielding shell and the insulative body of the second embodiment.
Figure 15:
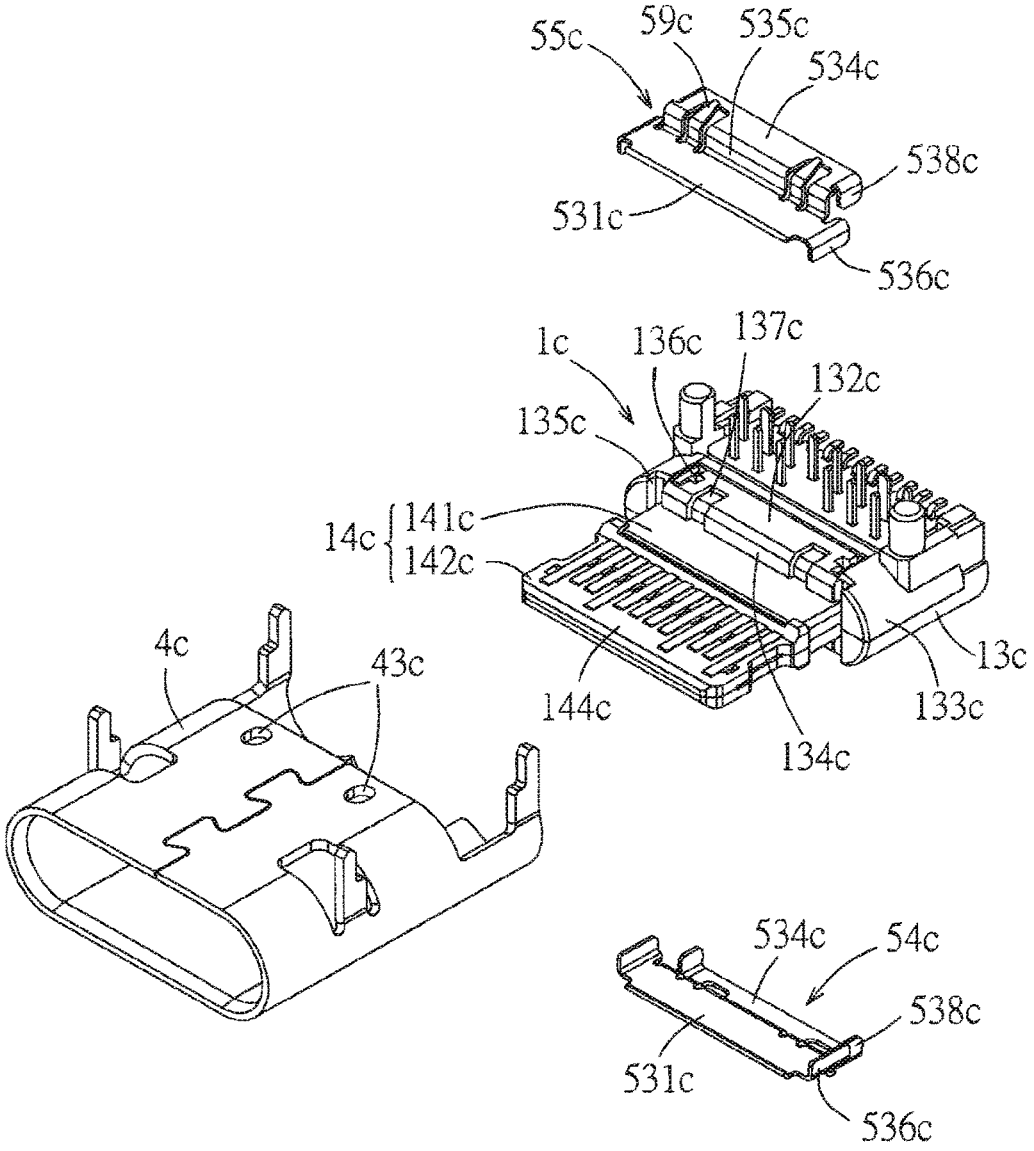
FIG. 15 is a view of FIG. 14 viewed from another angle.
Figure 16:
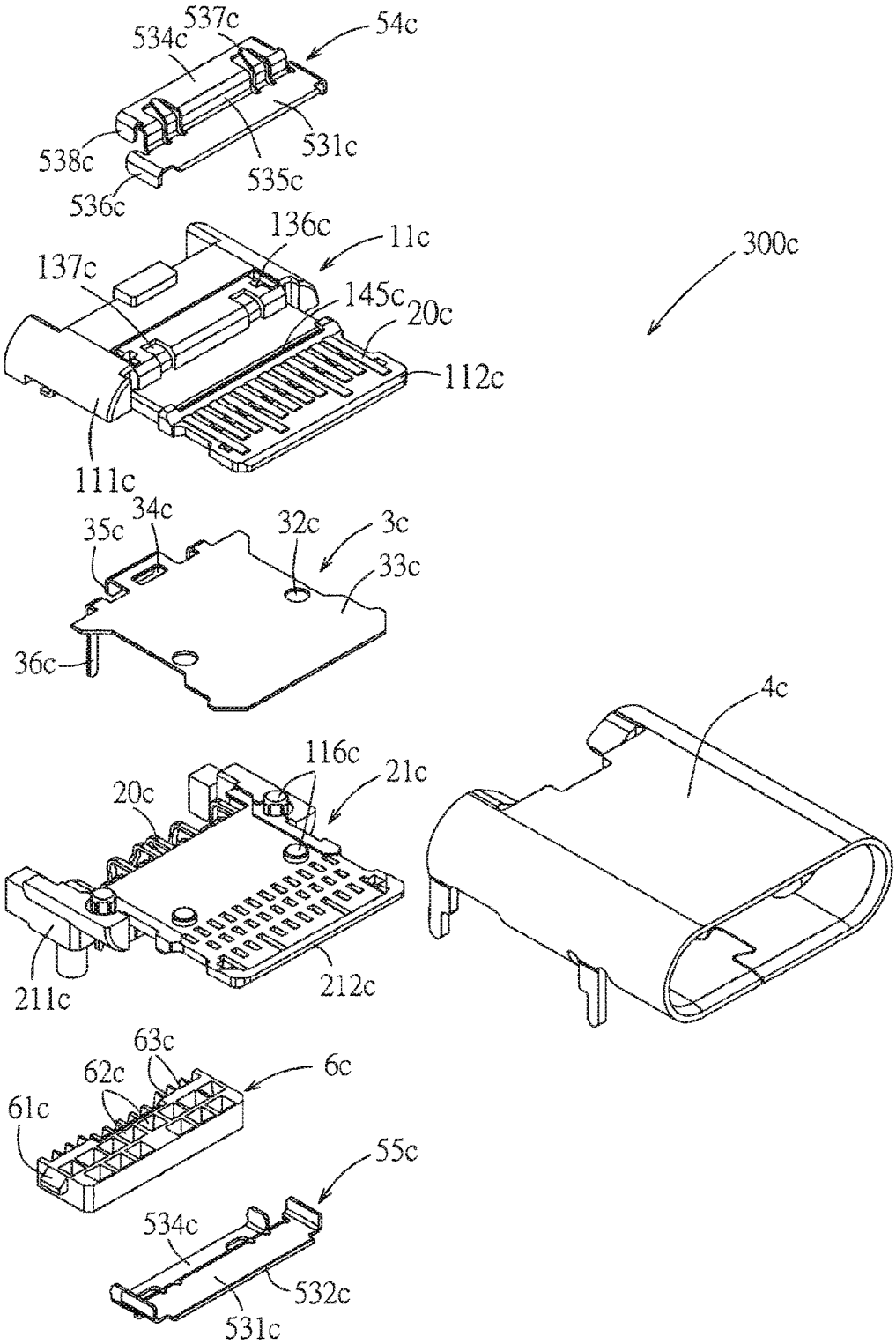
FIG. 16 is an exploded perspective view illustrating an combined relationship among a grounding metal plate, a soldering leg positioning member and the insulative body of the second embodiment.
Figure 17:
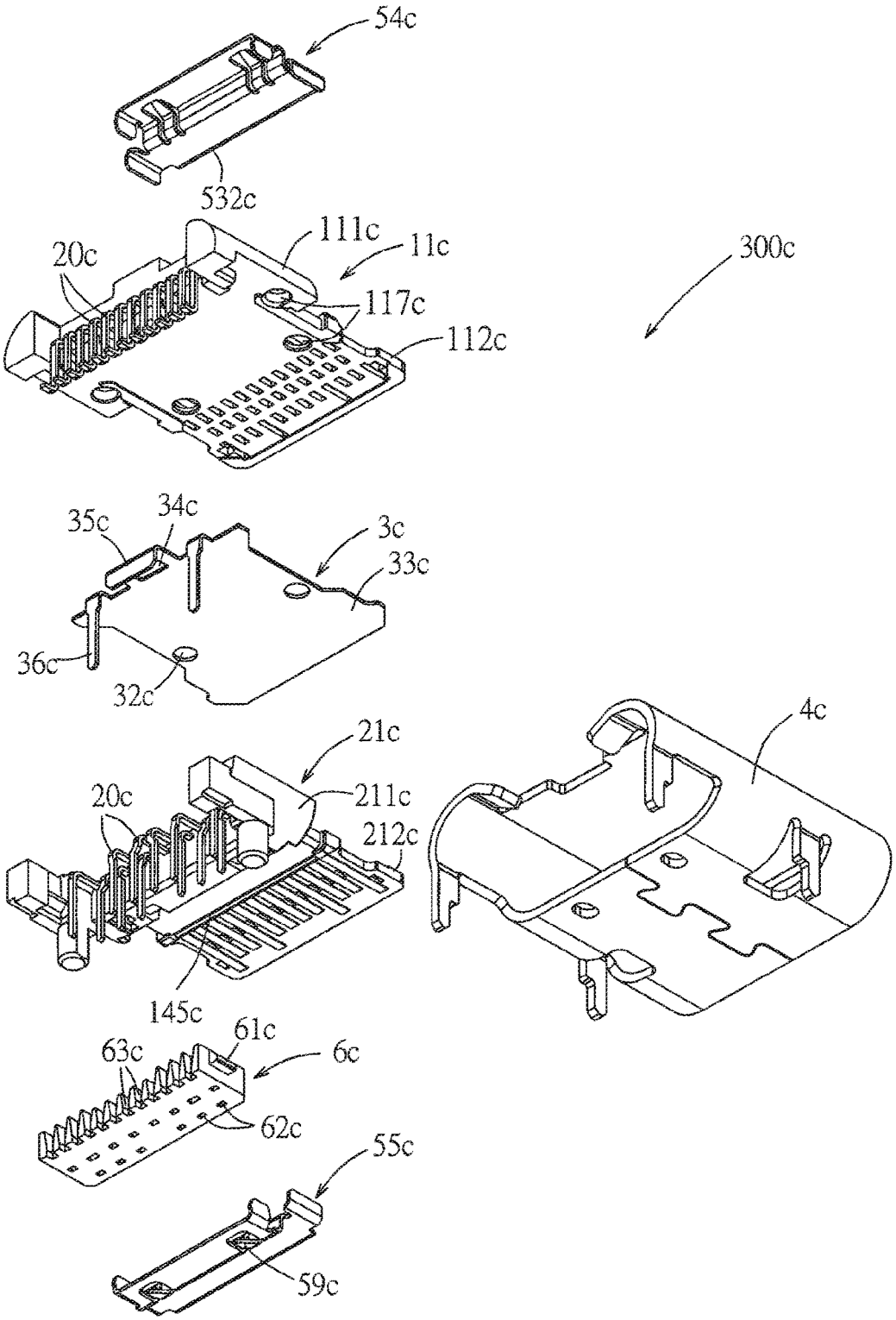
FIG. 17 is a view of FIG. 16 viewed from another angle.

Referring to FIG. 10 and FIG. 11, the electrical connector 300*c* may be provided to a circuit board 8*c* for matting of a mating connector 7*c*.

Referring to FIG. 11 to FIG. 17, the electrical connector 300*c* comprises an insulative body 10*c*, a plurality of terminals 20*c*, an outer shielding shell 4*c*, an inner shielding shell 5*c*, a grounding metal plate 3*c* and a soldering leg positioning member 6*c*.

The insulative body 10*c* is assembled by a first insulative piece 11*c* and a second insulative piece 21*c*, and has a main body 13*c* and a tongue 14*c* protruding forwards from the main body 13*c*. The main body 13*c* has a wider upper surface 131*c*, a wider lower surface 132*c*, two side surfaces 133*c* and a front surface 134*c* connecting the upper surface 131*c* and the lower surface 132*c*. The tongue 14*c* has a base portion 141*c* connected to the main body 13*c* and an extending portion 142*c* extending forwards from the base portion 141*c*. A thickness of the base portion 141*c* of the tongue 14*c* is larger than a thickness of the extending portion 142*c* of the tongue 14*c*. Specifically, in the second embodiment, the first insulative piece 11*c* comprises a first base portion 111*c* and a first tongue portion 112*c* extending forwards from the first base portion 111*c*; the second insulative piece 21*c* comprises a second base portion 211*c* and a second tongue portion 212*c* extending forwards from the second base portion 211*c*; the first tongue portion 112*c* and the second tongue portion 212*c* are assembled to form the tongue 14*c* of the insulative body 10*c*, the first base portion 111*c* and the second base portion 211*c* are assembled to form the main body 13*c* of the insulative body 10*c*.

Figure 18:
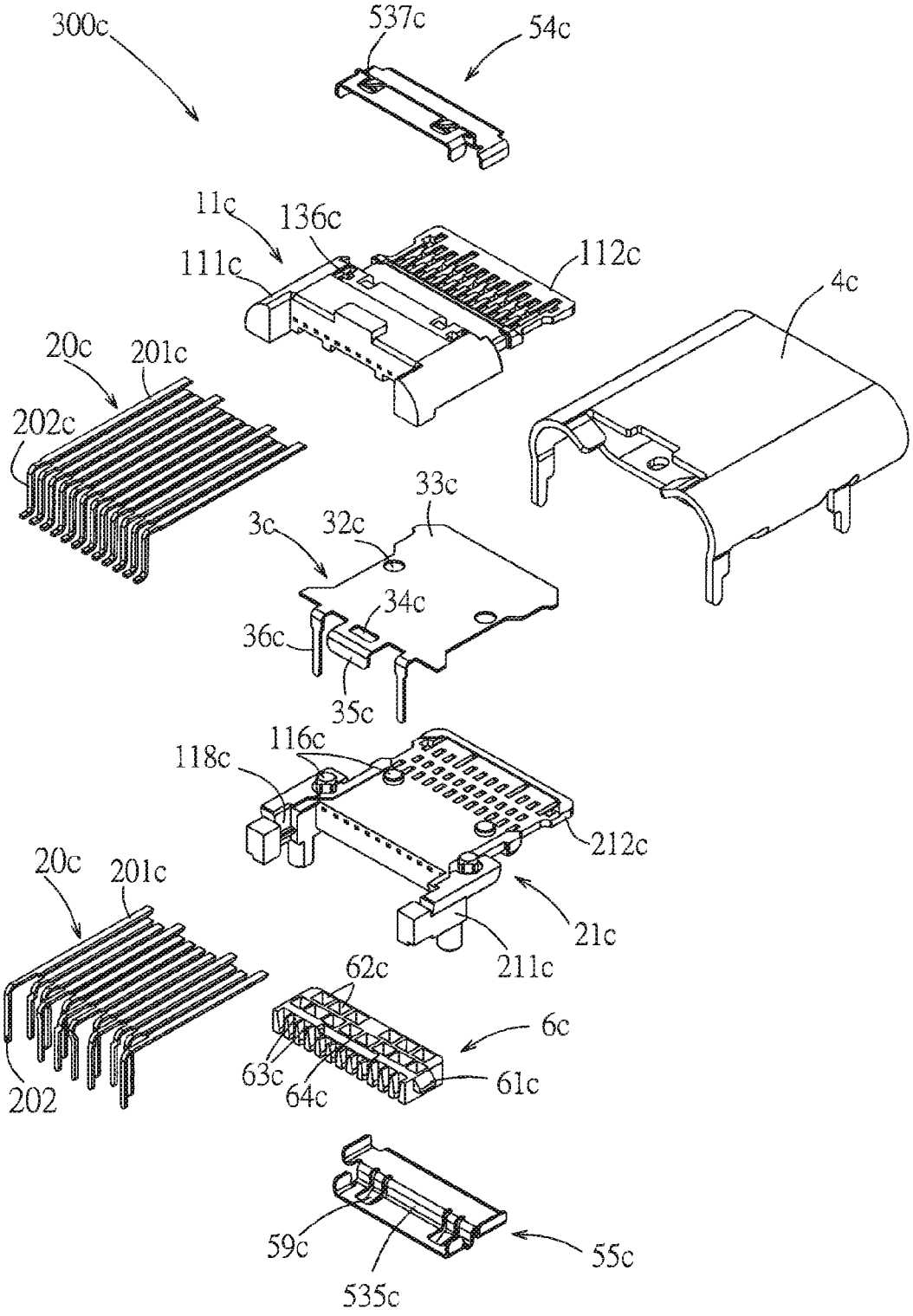
FIG. 18 is an exploded perspective view illustrating an combined relationship among terminals and a first insulative piece and a second insulative piece of the insulative body of the second embodiment.
Figure 19:
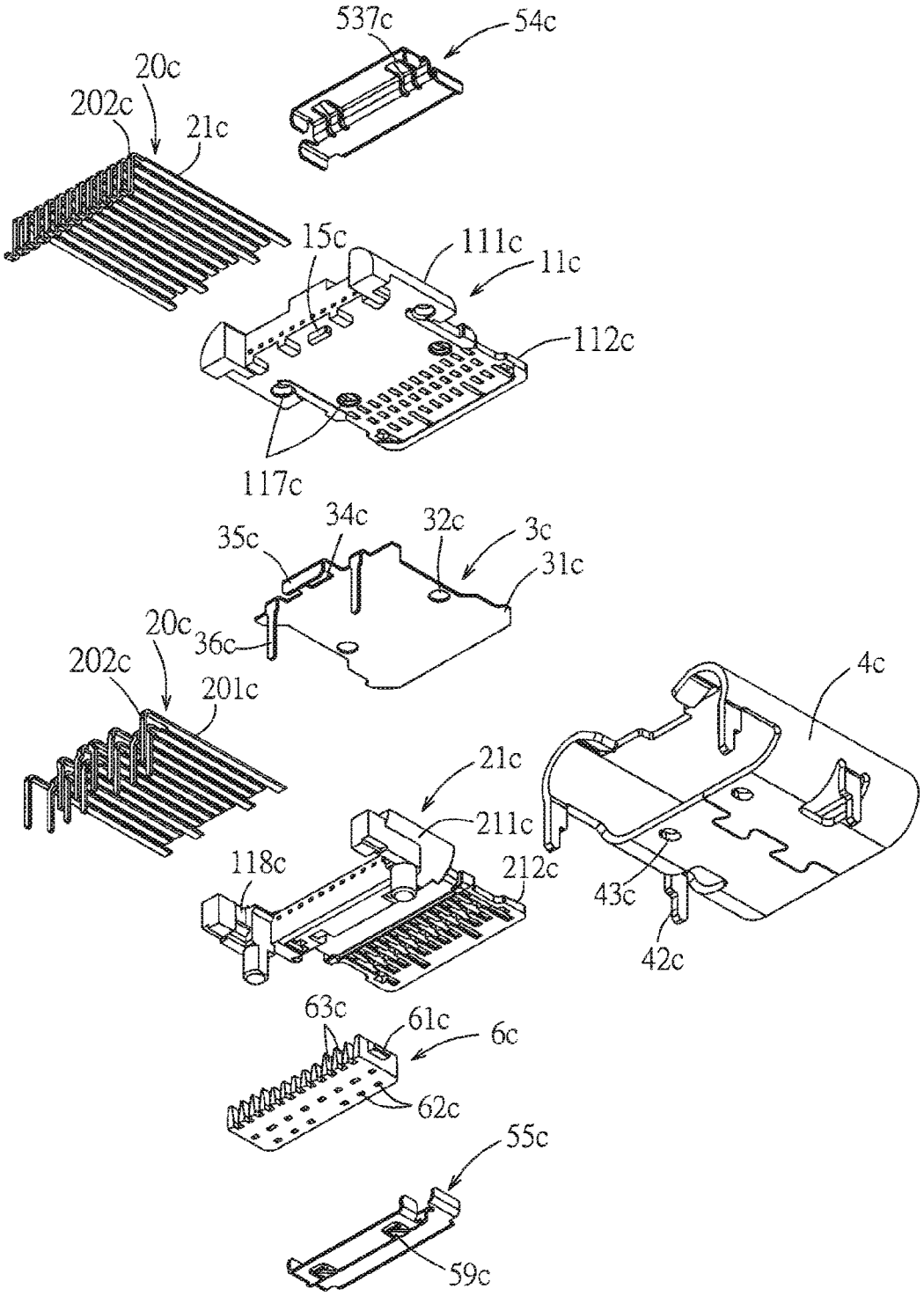
FIG. 19 is a view of FIG. 18 viewed from another angle.
Figure 20:
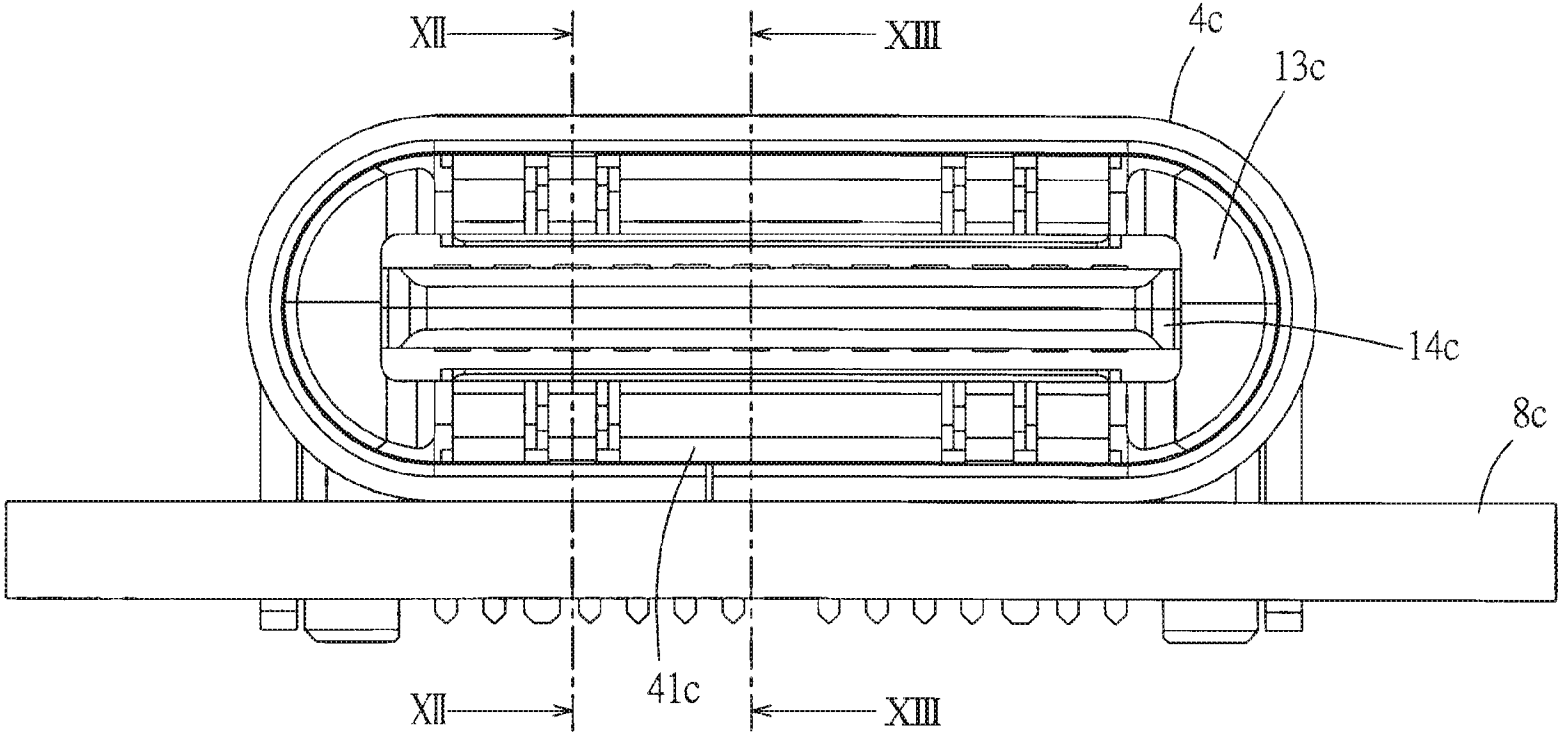
FIG. 20 is a front view illustrating the embodiment.
Figure 21:
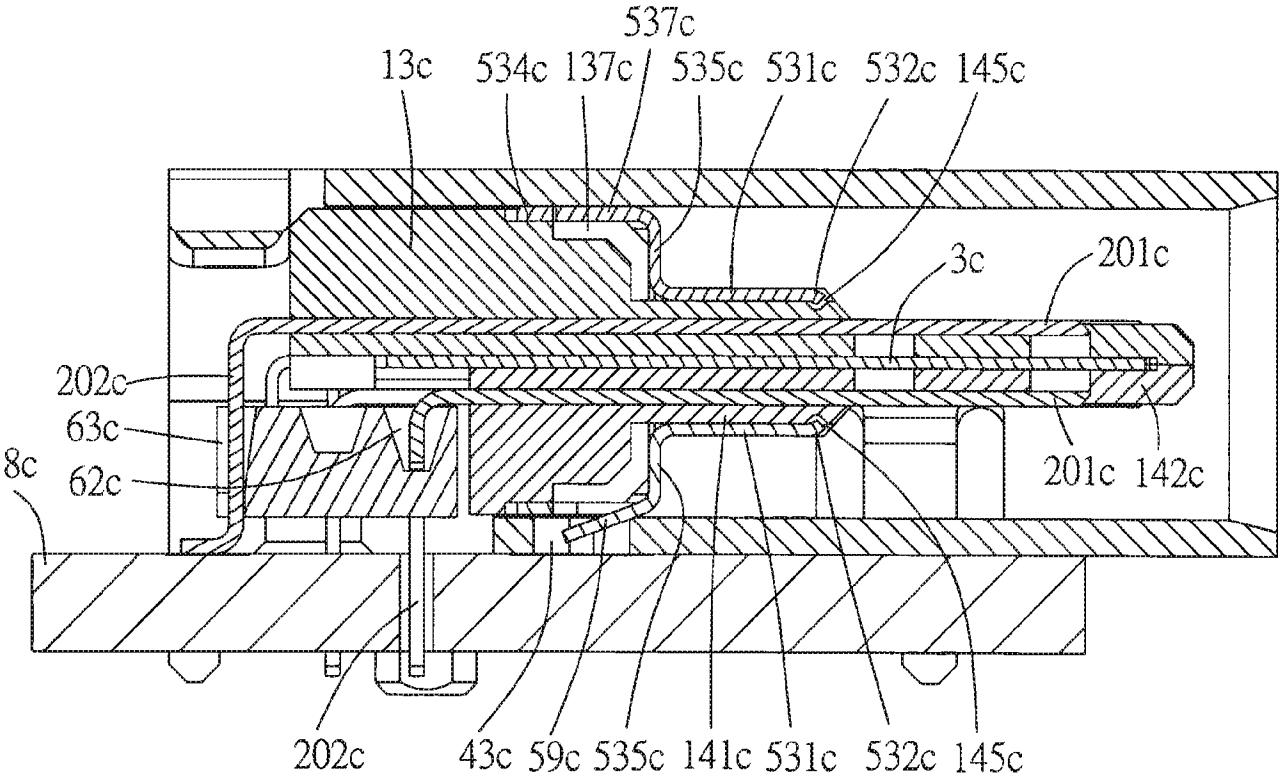
FIG. 21 is a cross sectional view taken along a line XII-XII of FIG. 20.

In combination with referring to FIG. 18 and FIG. 19, the terminals 20*c* are fixed at the insulative body 10*c* and each terminal 20*c* has a contact portion 201*c* exposed out of the extending portion 142*c* of the tongue 14*c*, and a tail portion 202*c* extending rearwards out of the main body 13*c* of the insulative body 10*c*. The contact portions 201*c* of the terminals 20*c* in an upper row are exposes on an upper surface 143*c* of the extending portion 142*c* of the tongue 14*c*, the contact portions 201*c* of the terminals 20*c* in a lower row are exposed on a lower surface 144*c* of the extending portion 142*c* of the tongue 14*c*. In particular, the terminals 20*c* are divided into the upper row and the lower row, the terminals 20*c* in the upper row are embedded in the first insulative piece 11*c*, the terminals 20*c* in the lower row are embedded in the second insulative piece 21*c*. The contact portions 201*c* of the terminals 20*c* in the upper row are exposed out of the first tongue portion 112*c*, and the tail portions 202*c* of the terminals 20*c* in the upper row extend rearwards out of the first base portion 111*c*; the contact portions 201*c* of the terminals 20*c* in the lower row are exposed out of the second tongue portion 212*c*, and the tail portions 202*c* of the terminals 20*c* in the lower row extend rearwards out of the second base portion 211*c*. Terminals 20*c* in each row comprise four terminals 20*c* protruding forwards and eight terminals 20*c* positioned rearwards relative to the four terminals 20*c*. In the four terminals 20*c* protruding forwards, two longer terminals 20*c* positioned on the two sides are used for grounding, two longer terminals 20*c* positioned in the middle are used to provide power. The eight shorter terminals 20*c* comprise two high speed differential signal pairs, a low speed differential signal pair positioned in the center and two controlling terminals. The contact portions 201*c* of the terminals 20*c* in the upper row and the contact portions 201*c* of the terminals 20*c* in the lower row are in 180 degrees symmetry relative to the tongue 14*c*, thereby making the mating connector 7*c* reversed by 180 degrees and inserted into the electrical connector 300*c*.

It should be understood that, an assembled configuration of the insulative body 10*c* and the terminal 20*c* is equivalent to the combined body 100 of the first embodiment. An assembled configuration of the terminals 20*c* in the upper row and the first insulative piece 11*c* is equivalent to the first terminal module 1 of the first embodiment; an assembled configuration of the terminals 20*c* in the lower row and the second insulative piece 21*c* is equivalent to the second terminal module 2 of the first embodiment.

The outer shielding shell 4*c* is combined with the insulative body 10*c* and surrounds an outer space of the tongue 14*c* to define a mating cavity 41*c*, and has four soldering legs 42*c* to be fixed to the circuit board 8*c*. A front surface 134*c* of the insulative body 10*c* faces the mating cavity 41*c*.

The inner shielding shell 5*c* covers the base portion 141*c* of the tongue 14*c* and the upper surface 131*c*, the lower surface 132*c* and the front surface 134*c* of the main body 13*c*, and has a plurality of fixed protruding tabs 536*c*, 538*c* for positioning the inner shielding shell 5*c*. Specifically, the inner shielding shell 5*c* comprises a first metal plate 54*c* and a second metal plate 55*c*. The first metal plate 54*c* has a front extending plate 531*c* covering the base portion 141*c*, a connecting plate 535*c* vertically bent from a rear end of the front extending plate 531*c* and extending, and a rear extending plate 534*c* extending horizontally and rearwards from an upper edge of the connecting plate 535*c*. The second metal plate 55*c* has a front extending plate 531*c* covering the base portion 141*c*, a connecting plate 535*c* vertically bent from a rear end of the front extending plate 531*c* and extending, and a rear extending plate 534*c* extending horizontally and rearwards from a lower edge of the connecting plate 535*c*. The two front extending plates 531*c* respectively cover an upper side and a lower side of the base portion 141*c* of the tongue 14*c*, the two connecting plates 535*c* cover the front surface 134*c* of the main body 13*c*, the two rear extending plates 534*c* respectively cover the upper surface 131*c* and the lower surface 132*c* of the main body 13*c*. In other words, the first metal plate 54*c* and the second metal plate 55*c* together cover the upper side and the lower side of the base portion 141*c* of the tongue 14*c*, that is, the inner shielding shell 5*c* covers the base portion 141*c* of the tongue 14*c*, so as to surround the terminals 20*c* therein, and there is a gap between the inner shielding shell 5*c* and each terminal 20*c*. In some simplified embodiments (not shown), the inner shielding shell 5*c* may also be provided to only cover the base portion 141*c* of the tongue 14*c*, or only cover the base portion 141*c* of the tongue 14*c* and the front surface 134*c* of the main body 13*c*, thereby achieving the ground shielding effect to some extent and preventing the electromagnetic radiation in the mating cavity 41*c* from passing through the insulative body 10*c* to leak rearwards and affecting the tail portion 202*c* of the terminal 20*c*, therefore an object of improving the quality of the signal transmission of the terminals 20*c* and preventing the electromagnetic radiation from leaking to the outside of the electrical connector 300*c* is achieved.

The insulative body 10*c* further has two channels 135*c* adjacent to two sides of the base portion 141*c* of the tongue 14*c* and extending vertically, a plurality of latch grooves 136*c* respectively formed on the upper surface 131*c* and the lower surface 132*c*, and two receiving recessed portions 137*c* formed on the upper surface 131*c*. In some equivalent embodiments, rear ends of the two channels are ended to the front of the main body 13*c* or a joint (not shown) between the main body 13*c* and the tongue 14*c*, the four fixed protruding tabs 536*c* are respectively formed on the two transversal sides of the two front extending plates 531*c* and are inserted and latch in the corresponding channel 135*c*, thereby achieving an object of fixing the two front extending plates 531*c*. Specifically, in the embodiment, the two channels 135*c* further extend rearwards into the main body 13*c* of the insulative body 10*c* with a predetermined depth, and vertically penetrate the main body 13*c*; rear portions of the four fixed protruding tabs 536*c* are inserted into the channels 135*c* formed on the main body 13*c* so as to be latched in the channels 135*c* by the main body 13*c*, thereby preventing the four fixed protruding tabs 536*c* from expanding outwards to deform; preferably, the four fixed protruding tabs 538*c* are respectively formed on the two transversal sides of the two rear extending plates 534*c* to insert and latch in the corresponding latch grooves 136*c*, so as to strengthen the fixing of the first metal plate 54*c* and the second metal plate 55*c*; the other two soldering legs 59*c* are formed on the connecting plate 535*c* and the rear extending plate 534*c* of the second metal plate 55*c*, each soldering leg 59*c* extends outwards from the front extending plate 531*c* toward the outer shielding shell 4*c*, the outer shielding shell 4*c* has two corresponding apertures 43*c* for receiving the corresponding soldering legs 59*c*, thereby making the soldering legs 59*c* corresponding to the apertures 43*c* soldered to the circuit board 8 (see FIG. 20, FIG. 21) so as to form a grounding effect and provide a fixing effect. The first metal plate 54*c* further has two connecting elastic tabs 537*c* formed on the connecting plate 535*c* and the rear extending plate 534*c*, the two connecting elastic tabs 537*c* extend outwards from the front extending plate 531*c* and contact the outer shielding shell 4*c* (see FIG. 21), thereby making the inner shielding shell 5*c* and the outer shielding shell 4*c* form a grounding and auxiliary fixing effect.

Preferably, a front edge of the inner shielding shell 5*c* has at least one arc guiding portion, the tongue 14*c* further has at least one receiving channel corresponding to the guiding portion, there is a gap between the front end edge of each guiding portion and each receiving channel, thereby making the guiding portion slightly displace into the receiving channel. Specifically, in the embodiment, the first metal plate 54*c* further has a guiding front edge 532*c* formed on the front edge of the front extending plate 531*c* and having an arc shape, the second metal plate 55*c* further has a guiding front edge 532*c* formed on the front edge of the front extending plate 531*c* and having an arc shape. The tongue 14*c* further has two receiving channels 145*c* (see FIG. 21) respectively formed on the upper surface 143*c* and the lower surface 144*c* of the base portion 141*c*, so as to respectively receive the two guiding front edges 532*c*. During the mating process of the mating connector 7*c* (see FIG. 10) and the electrical connector 300*c*, the two guiding front edges 532*c* may make the mating front edge 73*c* of the mating connector 7*c* easily pass through without retardancy. Also, after the mating connector 7*c* is mated with the electrical connector 300*c*, a plurality of upper grounding elastic tabs 71*c* and a plurality of lower grounding elastic tabs 71*c* of the mating connector 7*c* may contact and mate with the two front extending plates 531 of the inner shielding shell 5*c* to achieve a grounding effect, thereby forming a first grounding shielding configuration to prevent the electromagnetic radiation from passing through the insulative body 10*c* to leak rearwards. The outer shielding shell 4*c* contacts the shielding outer shell 72*c* of the mating connector 7*c* to form a second grounding shielding configuration, thereby effectively achieving an entire surrounding and shielding effect on the outer space of the mating cavity 41*c*.

Referring to FIG. 16 to FIG. 19, the grounding metal plate 3*c* is interposed between the first insulative piece 11*c* and the second insulative piece 21*c*. The grounding metal plate 3*c* is a plate positioned between the terminals 20*c* in the upper row and the terminals 20*c* in the lower row, and comprises a first shielding portion 33*c* and a second shielding portion 35*c* extending from the first shielding portion 33*c*, and two grounding legs 36*c* respectively extending rearwards from the first shielding portion 33*c* and extending out of the insulative body 10*c* and positioned between the two sides of the second shielding portion 35*c*. The first shielding portion 33*c* is fixed in the insulative body 10*c*, the second shielding portion 35*c* and the tail portions 202*c* of the terminals 20*c* extend out of the insulative body 10*c* along a same direction. Specifically, the second shielding portion 35*c* is formed by being bent downwards from a rear end of the first shielding portion 33*c* of the grounding metal plate 3*c* and extending vertically, and extends between the tail portions 202*c* of the terminals 20*c* in the upper row and the tail portions 202*c* of the terminals 20*c* in the lower row along a transverse direction. In the embodiment, the second insulative piece 21*c* has a plurality of fixing protruding posts 116*c*, and the first insulative piece 11*c* has a plurality of fixing holes 117*c* respectively engaged with the fixing protruding posts 116*c*, the grounding metal plate 3*c* has a plurality of through holes 32*c* formed on the first shielding portion 33*c* for passing through of the corresponding fixing protruding posts 116*c*. Of course, in an equivalent embodiment, the first insulative piece 11*c* may have a plurality of fixing protruding posts, and the second insulative piece 21*c* may have a plurality of fixing holes. The grounding metal plate 3*c* may enhance the strength of the tongue 14*c* and decrease the high frequency crosstalk during the signal transmission between the terminals 20*c* in the upper row and the terminals 20*c* in the lower row, particularly, the second shielding portion 35*c* extends between the tail portions 202*c* of the terminals 20*c* in the upper row and the tail portions 202*c* of the terminals 20*c* in the lower row along a transverse direction, thereby further enhancing the shielding effect, and improving the electrical performance of the terminals 20*c* by the grounding of the grounding legs 36*c*. Furthermore, referring to FIG. 10 and FIG. 12, the tongue 14*c* further has two latching portions 146*c* respectively recessed from two sides of the extending portion 142*c*, parts of side edges of the grounding metal plate 3*c* are respectively exposed out of these latching portions 146*c*, therefore, latching elastic tabs (not shown) of the mating connector 7*c* may latch on to the corresponding latching portions 146*c* and contact the grounding metal plate 3*c* when the mating connector 7*c* and the electrical connector 300*c* are mated, and the mating connector 7*c* is grounded via the grounding legs 36*c* of the grounding metal plate 3*c*, a better grounding effect of the mating connector 7*c* is achieved.

Referring to FIG. 18 to FIG. 21, the soldering leg positioning member 6*c* and the main body 13*c* of the insulative body 10*c* are engaged and fixed together. In particular, the soldering leg positioning member 6*c* is engaged with the rear side of the second insulative piece 21*c* and is positioned below the first insulative piece 11*c*, and has two latching blocks 61*c* respectively protruding from two sides of the soldering leg positioning member 6*c* so as to engage with limiting grooves 118*c* on the second insulative piece 21*c*, and a plurality of positioning holes 62*c*, 63*c* penetrating vertically for passing though and positioning of the tail portions 202*c* of the terminals 20*c* and the grounding legs

36*c* of the grounding metal plate 3*c*, thereby preventing the tail portions 202*c* and the grounding legs 36*c* from being deformed. In the embodiment, the tail portions 202*c* of the terminals 20*c* in the lower row extend straightly, vertically and downwards to form soldering legs which are used for via soldering. Ends of the tail portions 202*c* of the terminals 20*c* in the upper row are bent to form soldering legs which are used for surface soldering, and are positioned behind the tail portions 202*c* of the terminals 20*c* in the lower row, the positioning holes 63*c* of the soldering leg positioning member 6*c* in a rear row further penetrate a rear side surface of the soldering leg positioning member 6*c* for passing through of the tail portions 202*c* of the terminals 20*c* in the upper row. Moreover, the soldering leg positioning member 6*c* further has a positioning recessed portion 64*c* to correspondingly receive an end of the second shielding portion 35*c* of the grounding metal plate 3*c* (see FIG. 22), the positioning recessed portion 64*c* is positioned between the positioning holes 63*c* receiving the corresponding terminals 20*c* in the upper row and the positioning holes 62*c* receiving the corresponding terminals 20*c* in the lower row.

Figure 22:
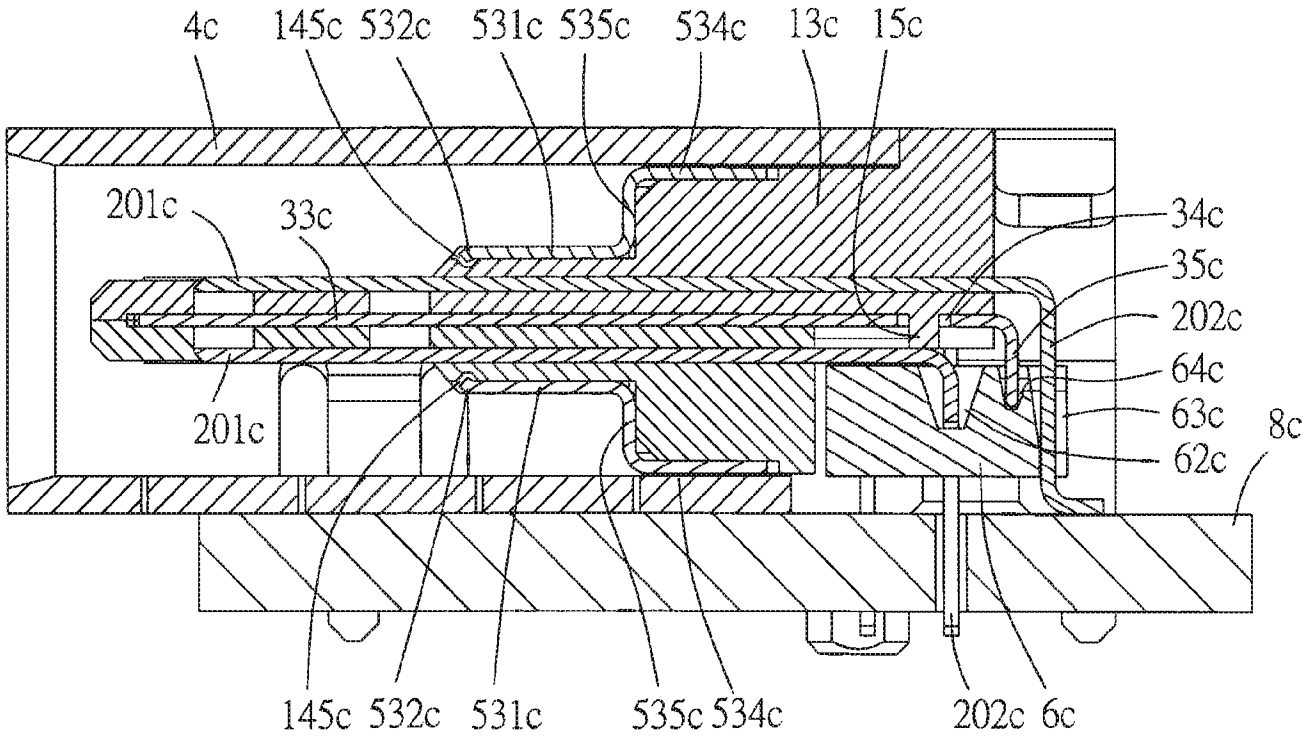
FIG. 22 is a cross sectional view taken along a line XIII-XIII of FIG. 20.
Figure 24:
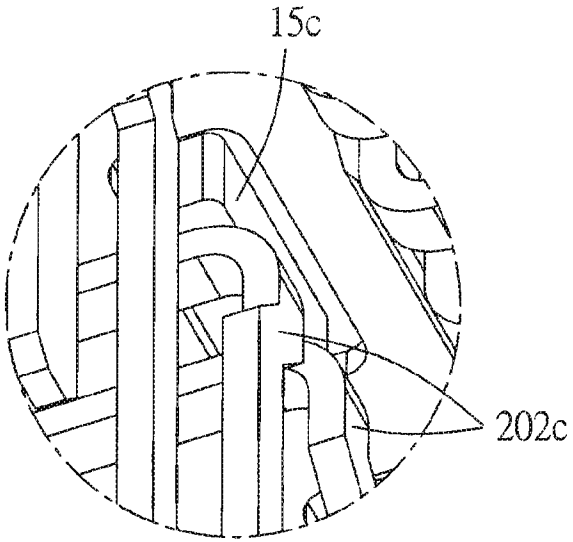
FIG. 24 is a partial view of FIG. 23 illustrating the functional relationship between the terminal spaced portion and the terminal tail portion of the second embodiment.
Figure 23:
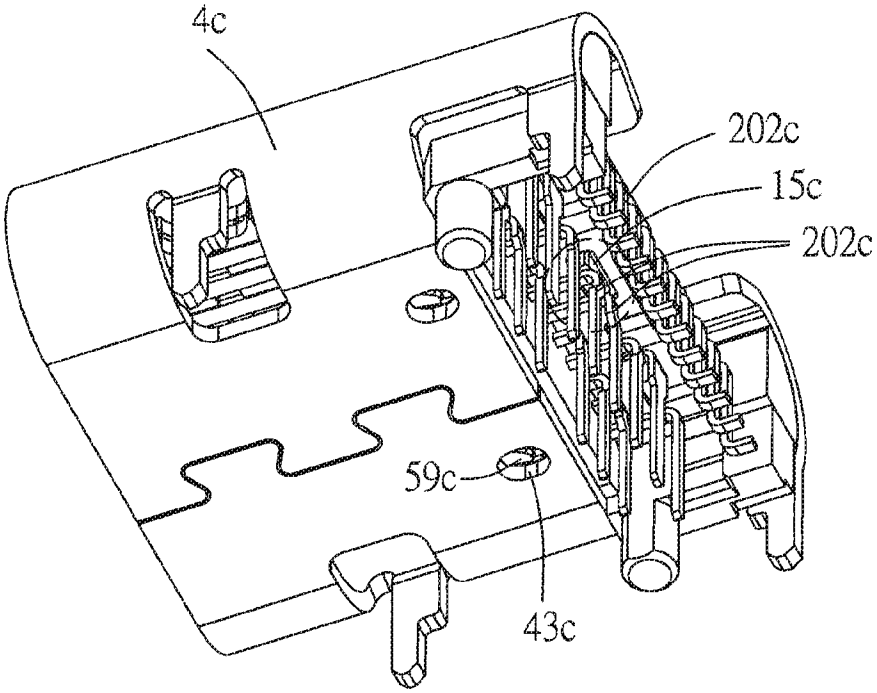
FIG. 23 is a perspective view illustrating a functional relationship between a terminal spaced portion and a terminal tail portion of the second embodiment.

Referring to FIG. 19 and FIG. 22 to FIG. 24, the first insulative piece 11*c* protrudes further rearwards relative to the second insulative piece 21*c*, and a terminal spaced portion 15*c* protrudes from a bottom surface of the part of the first insulative piece 11*c* protruding further rearwards relative to the second insulative piece 21*c*. A rear portion of the grounding metal plate 3*c* is provided with an aperture 34*c* for passing through of the terminal spaced portion 15*c*. Referring to FIG. 22 to FIG. 24, the terminal spaced portion 15*c* abuts against the tail portions 202*c* of the two terminals 20*c* in the lower row positioned in the middle which protrude further rearwards relative to other terminals 20*c*, so as to prevent the tail portions 202*c* of the terminals 20*c* from being bent upwards and deformed to contact the grounding metal plate 3*c* to cause a short circuit when the tail portions 202*c* of the terminals 20*c* are mounted to the circuit board 8*c*.

In conclusion, the electrical connector 300*c* of the present disclosure enhances the strength of the tongue 14*c* and decreases the high frequency crosstalk during the signal transmission of the terminals 20*c* via the grounding metal plate 3*c*, and the second shielding portion 35*c* extends between the tail portions 202*c* of the terminals 20*c* in the upper row and the tail portions 202*c* of the terminals 20*c* in the lower row along a transverse direction, thereby further increasing the shielding effect, and achieving the object of improving the electrical performance and further increasing the grounding shielding effect. Moreover, the insulative body 10*c* is assembled by the first insulative piece 11*c* and the second insulative piece 21*c*, and then further assembled with the soldering leg positioning member 6*c* for passing through and positioning of the tail portions 202*c* of the terminals 20*c* and the grounding legs 36*c* of the grounding metal plate 3*c*, therefore the insulative component is assembled by three subcomponents, which is beneficial for the miniaturization of the electrical connector 300*c* and makes manufacture and assembling of the electrical connector 300*c* easier.

However, what have been described above are only embodiments of the present disclosure, the implementation scope of the present disclosure is not limited to that, that is, simple equivalent variations and modifications made according to the Claims and the description content of the present disclosure are still included in the protective scope of the present disclosure.

What is claimed is:

1. An electrical connector suitable to mate with another mating connector, the electrical connector comprising:

a combined body comprising:

a first terminal module having a first insulative piece and a plurality of first terminals fixed to the first insulative piece, the first insulative piece having a first base portion and a first tongue portion extending forwards from the first base portion, the first tongue portion having a first combined surface and a first mating surface opposite to each other, one end of each first terminal extending forwards from the first base portion to form a first mating portion exposed on the first mating surface, and the other end of each first terminal extending outwards from the first base portion to form a first soldering portion; and a second terminal module having a second insulative piece assembled with the first insulative piece and a plurality of second terminals fixed to the second insulative piece, the second insulative piece having a second base portion and a second tongue portion extending forwards from the second base portion, the second tongue portion having a second combined surface facing the first combined surface and a second mating surface opposite to the second combined surface, one end of each second terminal extending forwards from the second base portion to form a second mating portion exposed on the second mating surface, the other end of each second terminal extending outwards from the second base portion to form a second soldering portion;

a grounding metal plate interposed between the first terminal module and the second terminal module;

an outer shielding shell surrounding an outer space of the first tongue portion and an outer space of the second tongue portion and forming a mating cavity for insertion of the mating connector; and an inner shielding shell positioned between the outer shielding shell and the first base portion and the second base portion, the inner shielding shell covers at least a rear section of the first tongue portion and the second tongue portion.

2. The electrical connector of claim 1, wherein the first insulative piece further has at least a first fixing mechanism on the surface facing the second insulative piece; the second insulative piece is provided with a second fixing mechanism cooperating with and fixed to the first fixing mechanism.

3. The electrical connector of claim 2, wherein the grounding metal plate is formed with at least a through hole corresponding to the first fixing mechanism and the second fixing mechanism; the first fixing mechanism and the second fixing mechanism are respectively a fixing protruding post and a fixing hole which cooperate with each other, the first fixing mechanism passes through the through hole of the grounding metal plate to engage with the second fixing mechanism.

4. The electrical connector of claim 1, wherein two opposite surfaces of the grounding metal plate respectively attach on the first combined surface of the first tongue portion and the second combined surface of the second tongue portion, the grounding metal plate is provided with two mating side edges respectively exposed out of the first tongue portion and the second tongue portion.

5. The electrical connector of claim 1, wherein a configuration of the first terminal module is the same as a configuration of the second terminal module, and the configurations of the first and second terminal modules are in 180 degrees rotational symmetry, a fixed leg extend respectively from each of the first insulative piece and the second insulative piece.

6. The electrical connector of claim 1, wherein the first terminal module is provided above the second terminal module, at least a fixed leg extends downwards from the second base portion of the second insulative piece.

7. The electrical connector of claim 6, wherein the electrical connector further comprises a soldering leg positioning member fixed to the second terminal module; a plurality of soldering leg positioning holes are formed on the soldering leg positioning member for passing through and positioning the first soldering portions and the second soldering portions.

8. The electrical connector of claim 1, wherein the inner shielding shell comprises a fixed section and an extending section, the fixed section abuts against an inner surface of the outer shielding shell and is fixed to the first base portion or the second base portion, the extending section covers the rear section of the first tongue portion and the second tongue portion.

9. The electrical connector of claim 1, wherein the inner shielding shell comprises two metal plates respectively attaching on the first insulative piece and the second insulative piece; each metal plate has a front extending plate attaching on the rear section of the first tongue portion or the rear section of the second tongue portion, a rear extending plate attaching on the corresponding first base portion or the corresponding second base portion and a connecting plate perpendicular to the front extending plate and the rear extending plate.

10. The electrical connector of claim 9, wherein a front end of each front extending plate forms a guiding front edge; a gap is formed between each guiding front edge and each combined body to allow the guiding front edge slightly displace toward the combined body.

11. The electrical connector of claim 9, wherein two sides of the combined body are further formed with two receiving grooves respectively adjacent to the two sides of the front extending plate; a rear side of each receiving groove has a channel extending vertically and penetrating the first base portion and the second base portion; each metal plate further has two fixed protruding tabs provided at two sides of the corresponding front extending plate; each fixed protruding tab extends from the corresponding front extending plate and extends into the adjacent receiving groove and latches on to the corresponding channel.

12. The electrical connector of claim 9, wherein each metal plate further has at least a connecting elastic tab extending away from the combined body; each connecting elastic tab is engaged with the outer shielding shell.

13. An electrical connector suitable to mate with another mating connector, the electrical connector comprising:

a combined body comprising:

an insulative body having a main body and a tongue protruding forwards from the main body, the tongue having an upper surface and a lower surface; and a plurality of terminals divided into an upper row and a lower row and fixed to the insulative body, each terminal comprising a contact portion extending forwards and exposed out of the tongue and a tail portion extending out of the insulative body, the contact portions of the terminals in the upper row being exposed on the upper surface of the tongue and the contact portions of the terminals in the lower row being exposed on the lower surface of the tongue;

a grounding metal plate fixed in the combined body and being a plate positioned between the terminals in the upper row and the terminals in the lower row;

an outer shielding shell combined with the insulative body and surrounding an outer space of the tongue to define a mating cavity; and an inner shielding shell positioned in an inner side of the outer shielding shell and provided on a surface of the combined body, the inner shielding shell comprising an upper metal plate and a lower metal plate, the upper metal plate having at least a connecting elastic tab extending away from the combined body, the connecting elastic tab being connected to the outer shielding shell.

14. The electrical connector of claim 13, wherein the lower metal plate has at least a connecting elastic tab extending away from the combined body, the connecting elastic tab is connected to the outer shielding shell.

15. The electrical connector of claim 13, wherein the lower metal plate has at least a soldering leg extending away from the combined body, the soldering leg extends out of the outer shielding shell and is soldered to the corresponding circuit board for achieving grounding.

16. The electrical connector of claim 13, wherein the grounding metal plate comprises a first shielding portion and a second shielding portion extending from the first shielding portion, the first shielding portion is fixed in the insulative body, the second shielding portion and the tail portions of the terminals extend out of the insulative body along the same direction.

17. The electrical connector of claim 13, wherein the outer shielding shell has at least a soldering leg to be soldered to the circuit board for achieving grounding.

18. The electrical connector of claim 13, wherein the insulative body is assembled by a first insulative piece and a second insulative piece, the terminals in the upper row are embedded in the first insulative piece, the terminals in the lower row are embedded in the second insulative piece, the grounding metal plate is interposed between the first insulative piece and the second insulative piece.

19. The electrical connector of claim 18, wherein the first insulative piece comprises a first base portion and a first tongue portion extending forwards from the first base portion, the contact portions of the terminals in the upper row are exposed out of the first tongue portion; the second insulative piece comprises a second base portion and a second tongue portion extending forwards from the second base portion, the contact portions of the terminals in the lower row are exposed out of the second tongue portion; the first tongue portion and the second tongue portion are assembled to form the tongue of the insulative body, the first base portion and the second base portion are assembled to form the main body of the insulative body.

20. An electrical connector suitable to mate with another mating connector, the electrical connector comprising:

a combined body comprising:

a first terminal module having a first insulative piece and a plurality of first terminals fixed to the first insulative piece, the first insulative piece having a first base portion and a first tongue portion extending forwards from the first base portion; and a second terminal module having a second insulative piece assembled with the first insulative piece and a plurality of second terminals fixed to the second insulative piece, the second insulative piece having a second base portion and a second tongue portion extending forwards from the second base portion;

a grounding metal plate interposed between the first terminal module and the second terminal module;

an outer shielding shell surrounding an outer space of the first tongue portion and an outer space of the second tongue portion and forming a mating cavity for insertion of the mating connector; and an inner shielding shell positioned between the outer shielding shell and the first base portion and the second base portion, the inner shielding shell covers at least a rear section of the first tongue portion and the second tongue portion.

21. The electrical connector of claim 20, wherein a configuration of the first terminal module is the same as a configuration of the second terminal module, and the configurations of the first and second terminal modules are in 180 degrees rotational symmetry.

22. An electrical connector suitable to mate with another mating connector, the electrical connector comprising:

a combined body comprising:

an insulative body having a main body and a tongue protruding forwards from the main body; and a plurality of terminals divided into an upper row and a lower row and fixed to the insulative body;

a grounding metal plate fixed in the combined body and being a plate positioned between the terminals in the upper row and the terminals in the lower row;

an outer shielding shell combined with the insulative body and surrounding an outer space of the tongue to define a mating cavity; and an inner shielding shell positioned in an inner side of the outer shielding shell and provided on a surface of the combined body, the inner shielding shell comprising an upper metal plate and a lower metal plate, the upper metal plate having at least a connecting elastic tab extending away from the combined body, the connecting elastic tab being connected to the outer shielding shell.

* * * * *